US010316460B2

(12) United States Patent
Forman

(10) Patent No.: US 10,316,460 B2
(45) Date of Patent: Jun. 11, 2019

(54) CLOTHES DRYER BOOSTER FAN SYSTEM

(71) Applicant: Suncourt, Inc., Durant, IA (US)

(72) Inventor: David J Forman, Coralville, IA (US)

(73) Assignee: Suncourt Inc., Durant, IA (US)

( * ) Notice: Subject to any disclaimer, the term of this patent is extended or adjusted under 35 U.S.C. 154(b) by 352 days.

(21) Appl. No.: 15/357,310

(22) Filed: Nov. 21, 2016

(65) Prior Publication Data

US 2017/0137990 A1 May 18, 2017

Related U.S. Application Data

(62) Division of application No. 15/092,062, filed on Apr. 6, 2016, now Pat. No. 9,587,347.

(60) Provisional application No. 62/165,068, filed on May 21, 2015, provisional application No. 62/144,108, filed on Apr. 7, 2015.

(51) Int. Cl.
*D06F 58/20* (2006.01)
*D06F 58/28* (2006.01)

(52) U.S. Cl.
CPC ..... *D06F 58/20* (2013.01); *D06F 58/28* (2013.01); *D06F 2058/2864* (2013.01)

(58) Field of Classification Search
CPC ... D06F 58/20; D06F 58/28; D06F 2058/2864
See application file for complete search history.

(56) References Cited

U.S. PATENT DOCUMENTS

| | | | | |
|---|---|---|---|---|
| 2,810,104 | A | 10/1957 | Wright | |
| 3,980,933 | A | 9/1976 | Piatkowski | |
| 5,101,575 | A | 4/1992 | Bashark | |
| 5,345,156 | A | 9/1994 | Moreira | |
| 5,696,430 | A | 12/1997 | Erdman et al. | |
| 5,838,134 | A | 11/1998 | Cummins | |
| 5,860,858 | A | 1/1999 | Wettergren | |
| 6,320,348 | B1 | 11/2001 | Kadah | |
| 6,671,977 | B2 | 1/2004 | Beaumont | |
| 6,864,659 | B2 | 3/2005 | Ratz et al. | |
| 6,954,044 | B2 | 10/2005 | McMillan et al. | |
| 7,262,578 | B2 | 8/2007 | Iotti | |
| 8,424,347 | B2 | 4/2013 | Maekawa | |
| 8,955,232 | B2 | 2/2015 | Cunningham | |
| 9,587,347 | B2 * | 3/2017 | Forman | D06F 58/20 |
| 2003/0030408 | A1 | 2/2003 | Ratz et al. | |
| 2010/0092275 | A1 | 4/2010 | Savitz | |

* cited by examiner

*Primary Examiner* — Jessica Yuen
(74) *Attorney, Agent, or Firm* — Simmons Perrine Moyer Bergman PLC

(57) ABSTRACT

A dryer exhaust duct power ventilator which is free of any dedicated internal air flow contacting devices for sensing air pressure or measuring fan RPMs and free of any hall effect sensor, but instead utilizes the auxiliary winding of a PSC motor on a centrifugal duct fan to measure the rotation of the motor and fan and thereby determine the pressure in the duct. A clip-on current sensor is located in the dryer power connection compartment and is used to detect operation of the dryer.

20 Claims, 29 Drawing Sheets

| FIG. 17A | FIG. 17B |
| --- | --- |
| FIG. 17C | FIG. 17D |

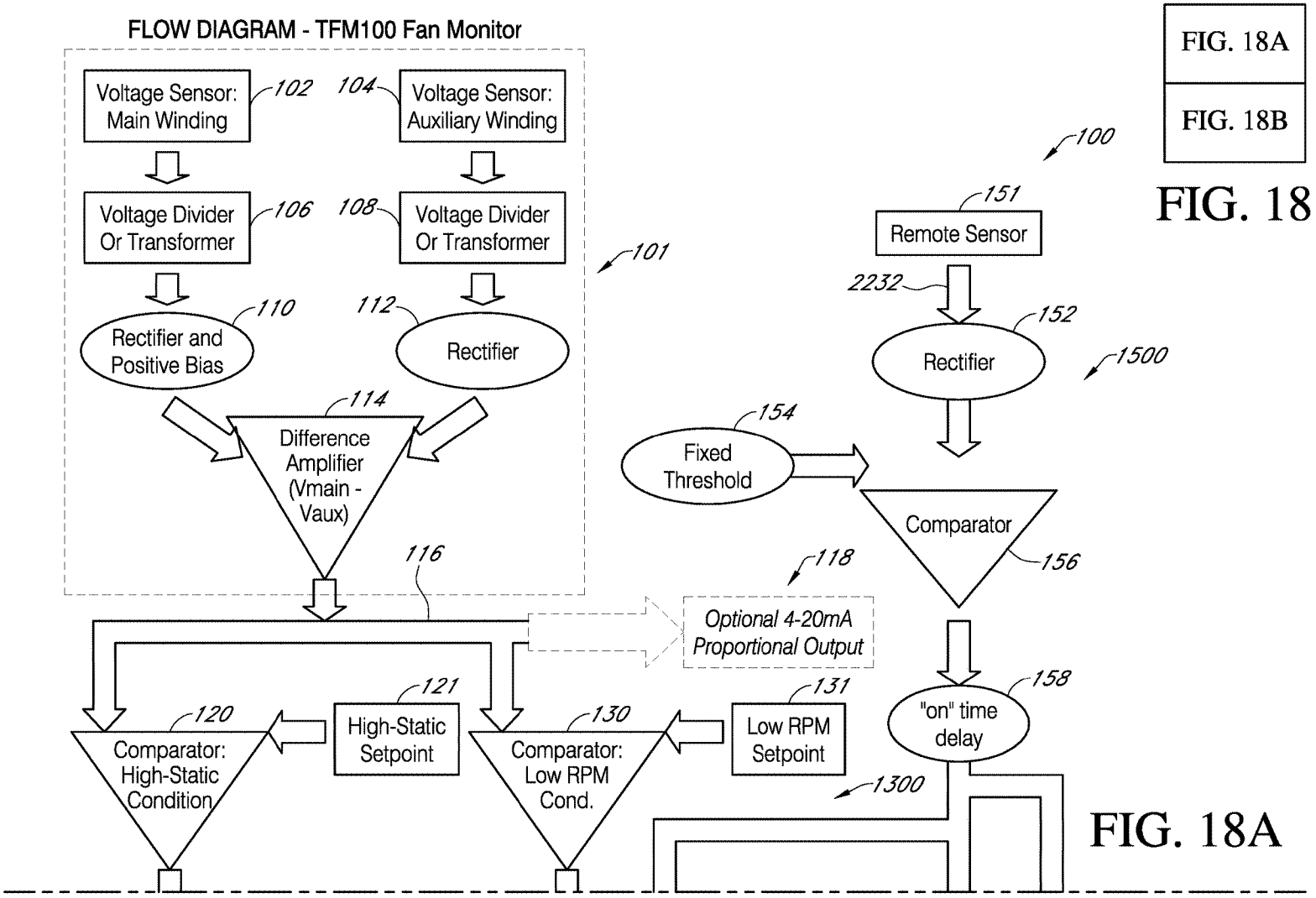
FIG. 18A
FIG. 18B
FIG. 18
FIG. 18A
FLOW DIAGRAM - TFM100 Fan Monitor
100
101
1500
1300
Voltage Sensor: Main Winding
102
Voltage Sensor: Auxiliary Winding
104
Voltage Divider Or Transformer
106
Voltage Divider Or Transformer
108
Rectifier and Positive Bias
110
Rectifier
112
Difference Amplifier (Vmain - Vaux)
114
116
Remote Sensor
151
2232
Rectifier
152
Fixed Threshold
154
Comparator
156
"on" time delay
158
Optional 4-20mA Proportional Output
118
Low RPM Setpoint
131
High-Static Setpoint
121
Comparator: Low RPM Cond.
130
Comparator: High-Static Condition
120

FLOW DIAGRAM - TFM100 Fan Monitor
190
Voltage Sensor: Auxiliary Winding
104
Voltage Divider Or Transformer
108
Rectifier
112
116
Remote Sensor
150
Rectifier
152
Fixed Threshold
154
Comparator
156
"on" time delay
158
Optional 4-20mA Proportional Output
118
Low RPM Setpoint
131
High-Static Setpoint
121
Comparator: Low RPM Cond.
130
Comparator: High-Static Condition
120

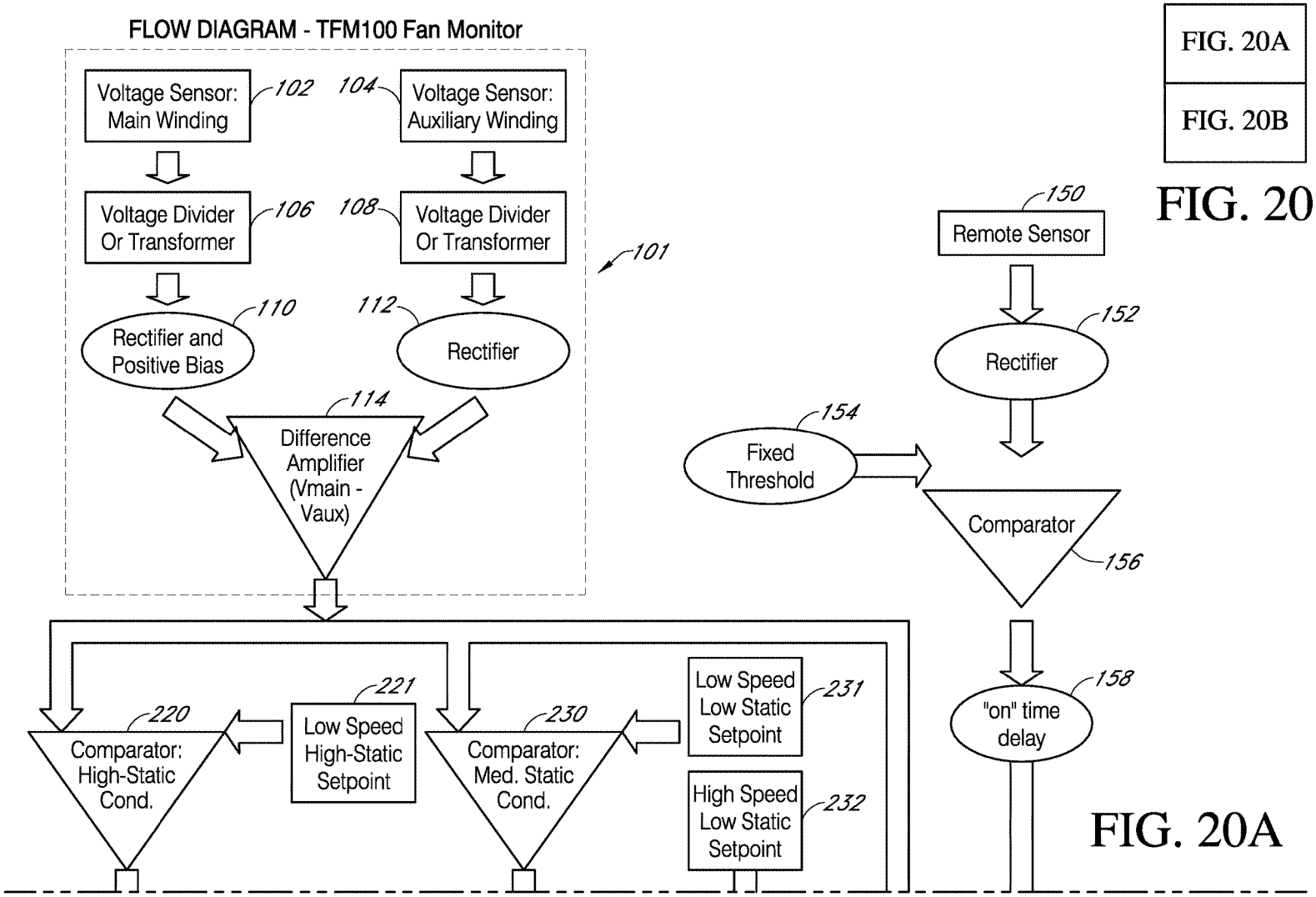
FIG. 20A
FIG. 20B
FIG. 20
FIG. 20A
FLOW DIAGRAM - TFM100 Fan Monitor
101
Voltage Sensor: Main Winding
102
Voltage Sensor: Auxiliary Winding
104
Voltage Divider Or Transformer
106
Voltage Divider Or Transformer
108
Rectifier and Positive Bias
110
Rectifier
112
Difference Amplifier (Vmain - Vaux)
114
Remote Sensor
150
Rectifier
152
Fixed Threshold
154
Comparator
156
"on" time delay
158
Low Speed High-Static Setpoint
221
Comparator: High-Static Cond.
220
Low Speed Low Static Setpoint
231
High Speed Low Static Setpoint
232
Comparator: Med. Static Cond.
230

FLOW DIAGRAM - TFM100 Fan Monitor
190
Voltage Sensor: Auxiliary Winding
Voltage Divider Or Transformer
Rectifier
150
Remote Sensor
152
Rectifier
154
Fixed Threshold
156
Comparator
158
"on" time delay
220
Comparator: High-Static Cond.
221
Low Speed High-Static Setpoint
230
Comparator: Med. Static Cond.
231
Low Speed Low Static Setpoint
232
High Speed Low Static Setpoint

CLOTHES DRYER BOOSTER FAN SYSTEM

CROSS REFERENCE TO RELATED APPLICATIONS

This application is a divisional of the non-provisional patent application filed on Apr. 6, 2016, and having Ser. No. 15/092,062, by the same inventor, with the same title; claims the benefit of the filing date of the provisional patent application filed on Apr. 7, 2015, and having Ser. No. 62/144,108, by the same inventor, with the same title; and the provisional application filed on May 21, 2015, having Ser. No. 62/165,068, by the same inventor and having the same title, which applications are incorporated herein by reference in their entireties.

FIELD OF THE INVENTION

The present invention relates to dryer exhaust ducts (DEDs) and dryer exhaust duct power ventilator (DEDPV) systems.

BACKGROUND OF THE INVENTION

In the past decades, clothes dryers have become common in many residences. Clothes dryers require adequate DED airflow to function properly. A dryer may at times suffer performance degradation, such as extended drying times, when the DED airflow is reduced. Excessive static pressure (the pressure against which the dryer exhaust fan must blow) can be inherent from restrictions and/or turns in the duct system, or just the length of duct. The end-user is often limited in their remediation of this particular problem. Relocating the dryer or the exhaust vent can be very difficult and often impossible. One common and relatively simple solution to this problem is to install a DEDPV, which may also be called a clothes dryer booster fan system. The booster fan mounts in-line within the dryer's existing exhaust duct. The proper booster fan will provide the requisite capacity to overcome the excess static pressure in a problematic exhaust duct system.

A simplified dryer booster fan system typically requires two components: a fan, and a control means which interlocks and reports failures in the booster fan's operation.

Typically, the booster fan is only energized while the dryer's exhaust fan is operating. A common approach is to use an inside the DED pressure sensor to control the booster fan. Another method of interlocking the booster fan operation to the dryer has been to use an internal to the dryer current sensor to sense operation of the dryer. This method has the advantage over the pressure sensor method in that the booster fan starts immediately when the dryer begins, continues without interruption or cycling, and turns off when the dryer stops (or within a specified duration thereafter). When the dryer is energized, the dryer current sensor, which may be located in a junction box in the wall next to the outlet providing power to the dryer, detects current being supplied to the dryer and turns the booster fan on. When the current sensor no longer detects this dryer current (i.e.: the dryer has ended its cycle), it turns the booster fan off.

While these prior art clothes dryer vent booster fan system have enjoyed considerable success in the past, there exists a need for improvement in several respects. The following description of the present invention is intended to address some of these needs.

SUMMARY OF THE INVENTION

It is an object of the present invention to provide an efficient method and system for interlocking a DEDPV with a dryer and for reporting to the status of the DEDPV to the end user of the dryer.

It is a feature of the present invention to eliminate the need for line voltage wiring work to occur in the wall adjacent the dryer, during the dryer current sensor installation.

It is an advantage of the present invention to allow for DEDPV installation by electrical installers with a lower ability level.

It is another feature of the present invention to include a simple clip on current sensor disposed in the wiring compartment in the back of the dryer.

It is another advantage of the present invention to allow for internal duct pressure sensing without the need for either a structure which contacts air in the duct for the sole purpose of determining the internal pressure in the duct, or an RPM detector which adds to the system additional moving parts or additional sensors to detect magnetic fields caused by pre-existing moving parts.

It is another feature of the present invention to include a voltage sensor for the auxiliary winding of the booster fan motor.

It is another advantage of the present invention to eliminate the need for a hall effect sensor.

It is another feature of the present invention to provide an electronic controller for controlling a fan blowing air through a duct and/or reporting on its status.

It is another advantage of the present invention to increase safety and utility of systems for moving air through ducts.

The present invention is designed to achieve the above-mentioned objectives, include the previously stated features, and provide the aforementioned advantages.

The present invention is a system for controlling airflow in a duct comprising: a means for determining a difference in winding voltages; where the difference in winding voltages is representative of an internal duct air pressure characteristic; a high static condition comparator; configured for comparing an output of said means for determining a difference in winding voltages and a high static set point; and a low static condition comparator; configured for comparing an output of said means for determining a difference in winding voltages and a low static set point.

DETAILED DESCRIPTION OF THE INVENTION

Figure 17A:
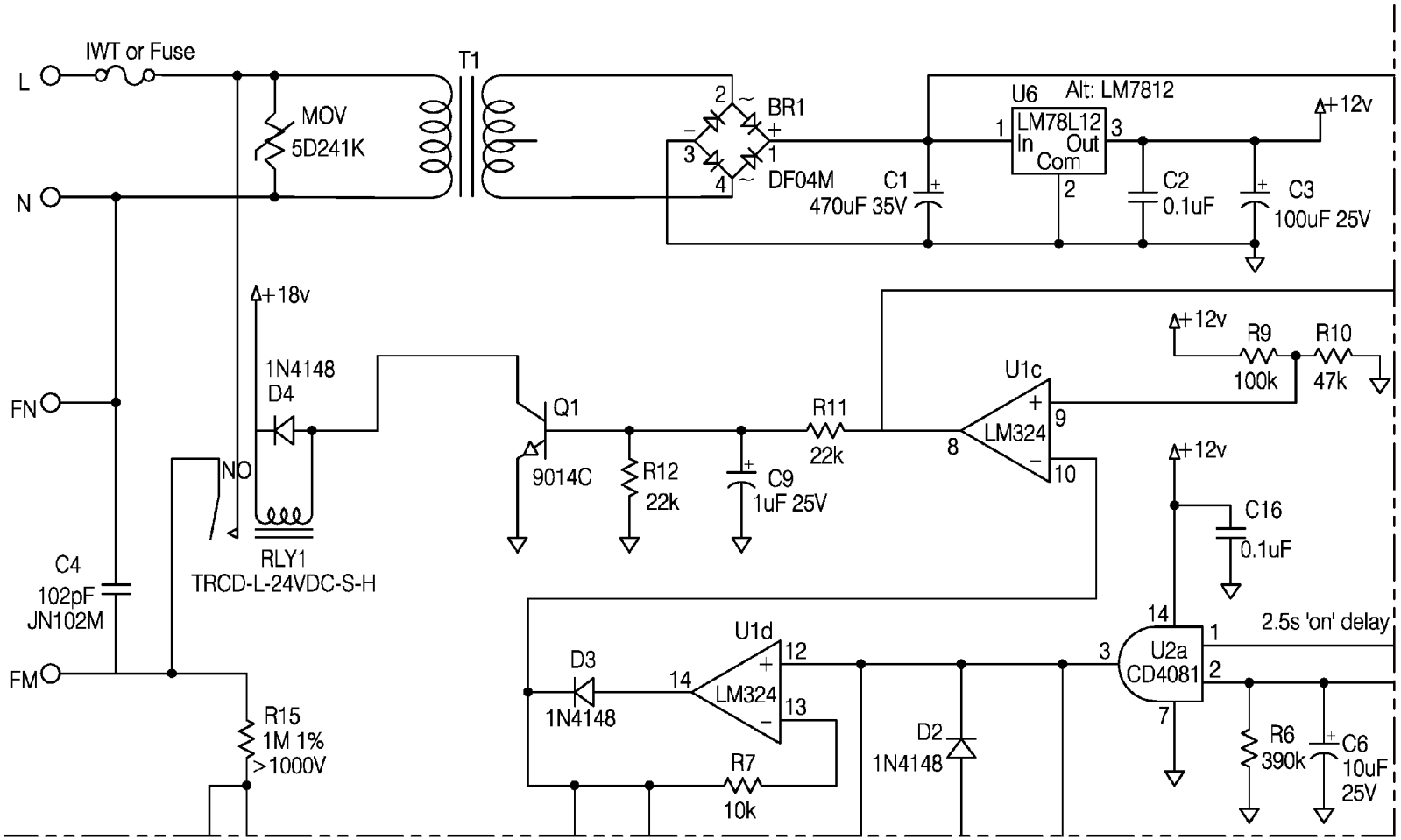
FIG. 17 is a schematic circuit diagram of an embodiment of the present invention.
Figures 17, 17B:
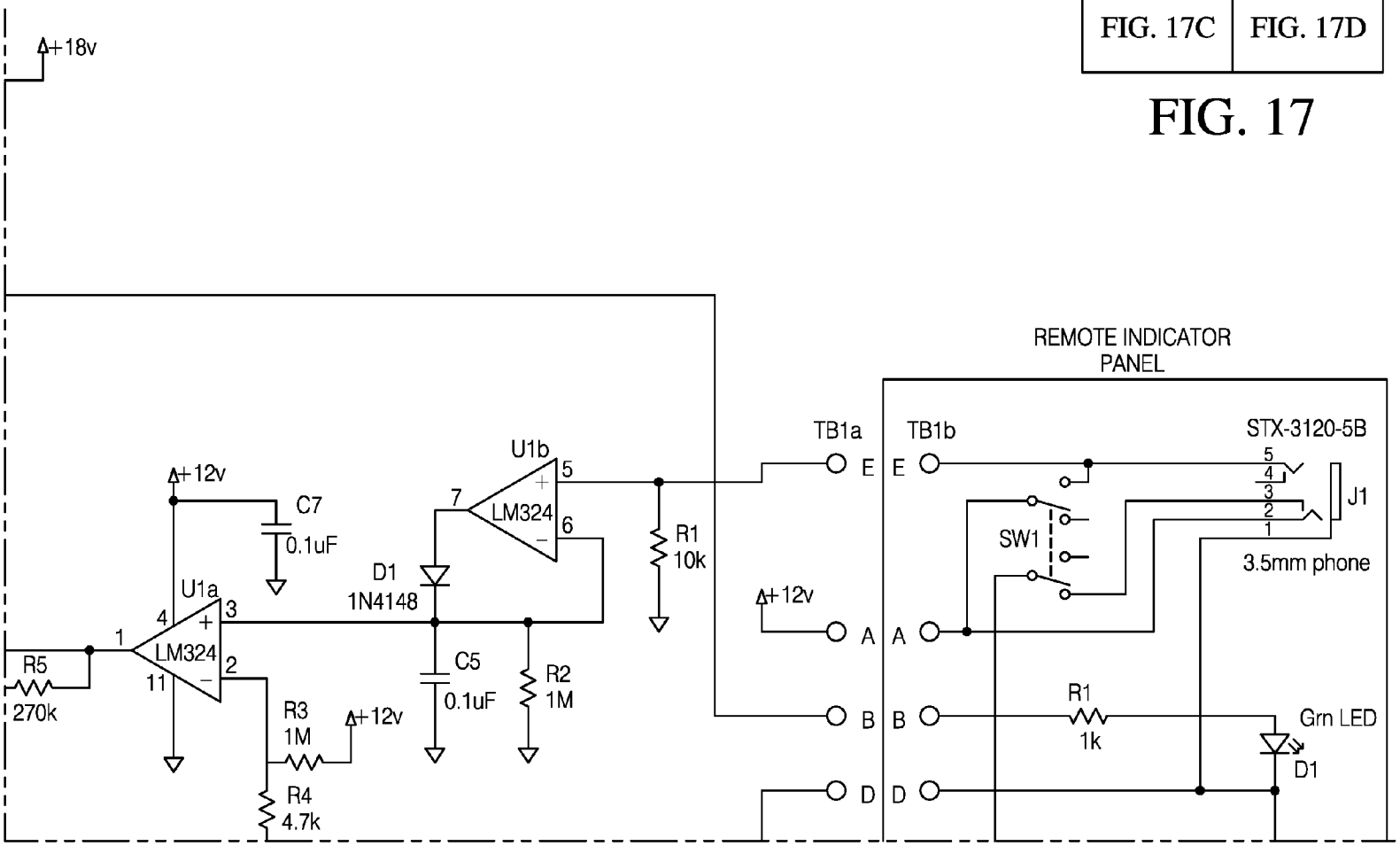
Figure 17C:
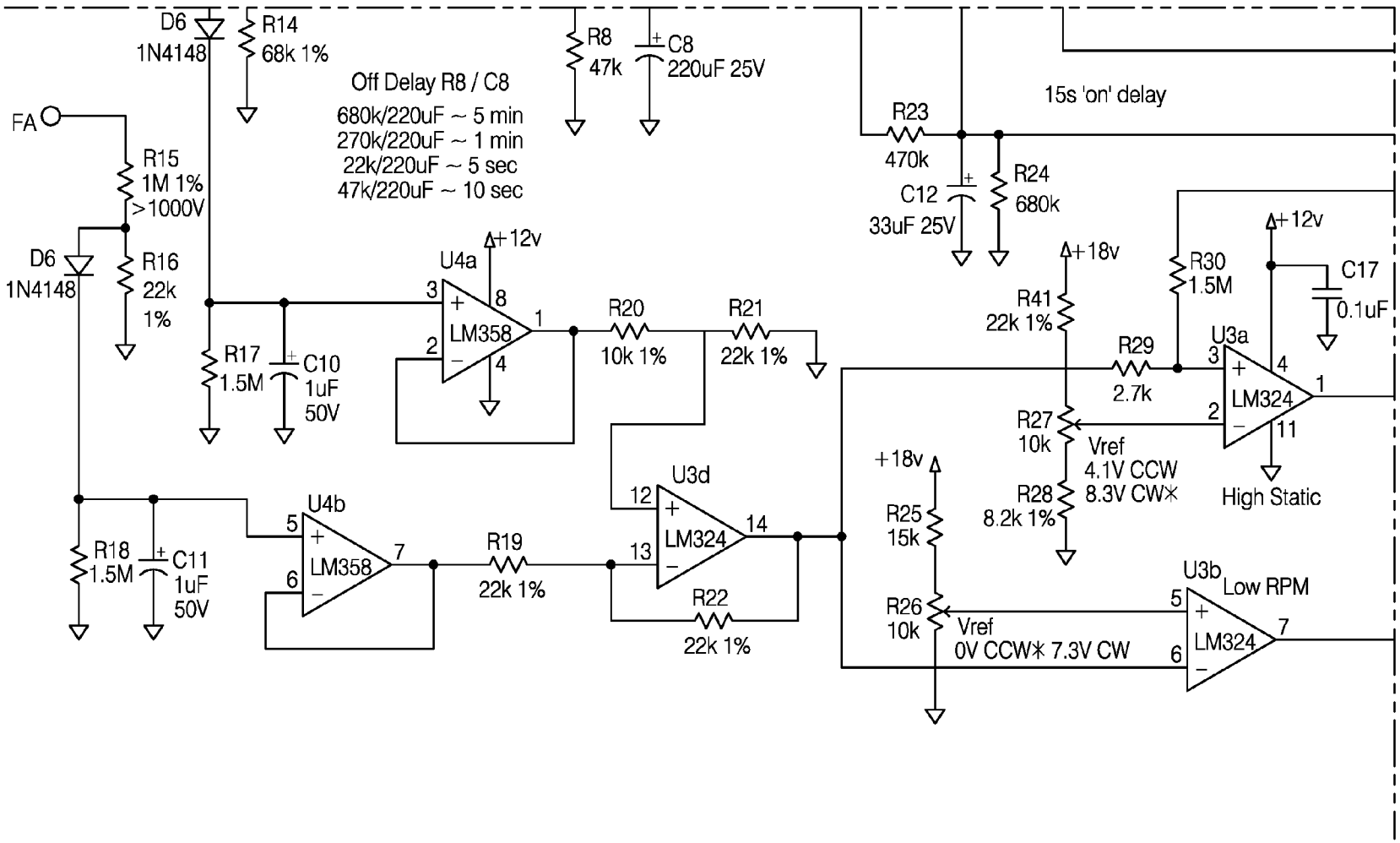
Figure 17D:
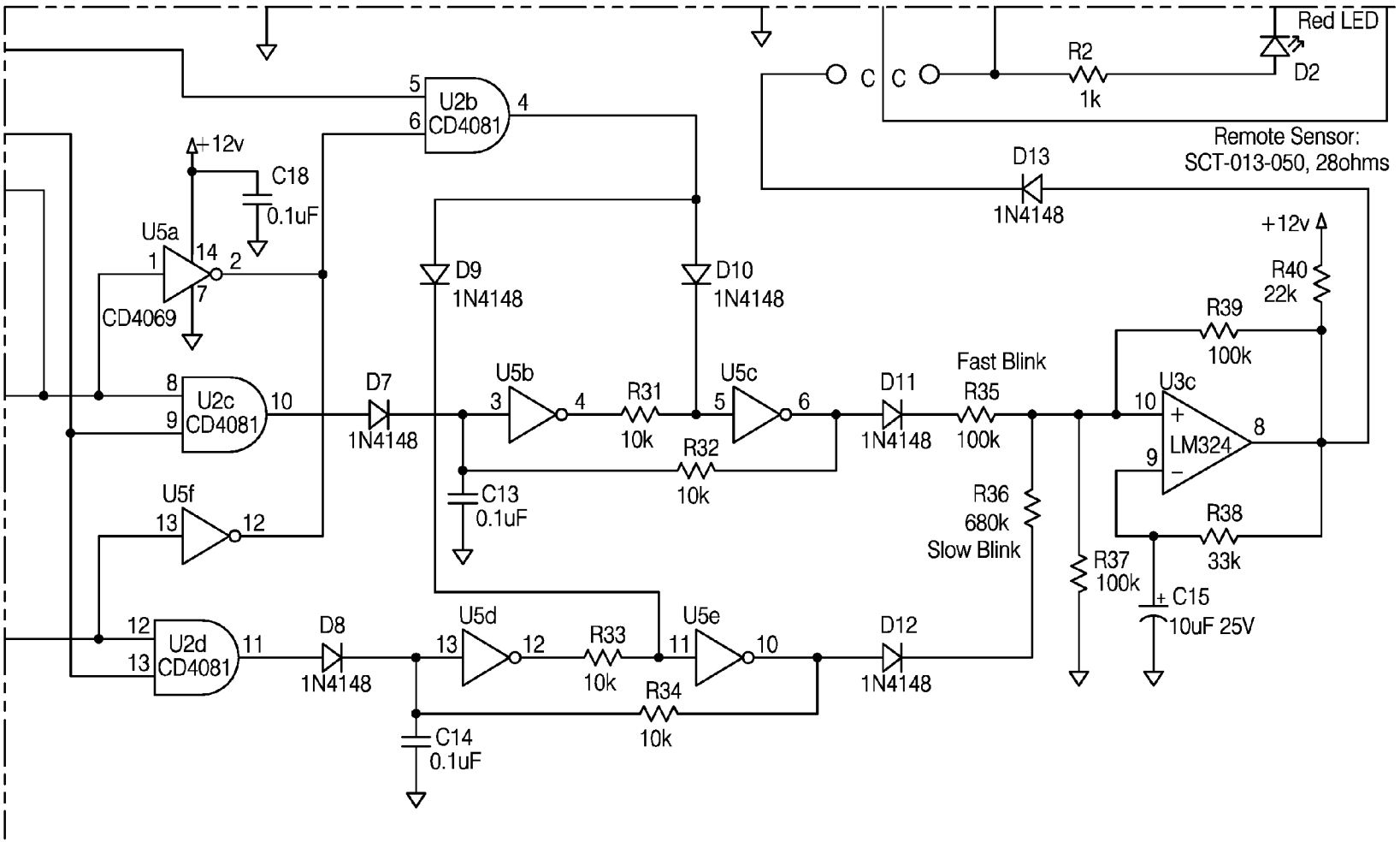
Figure 18B:
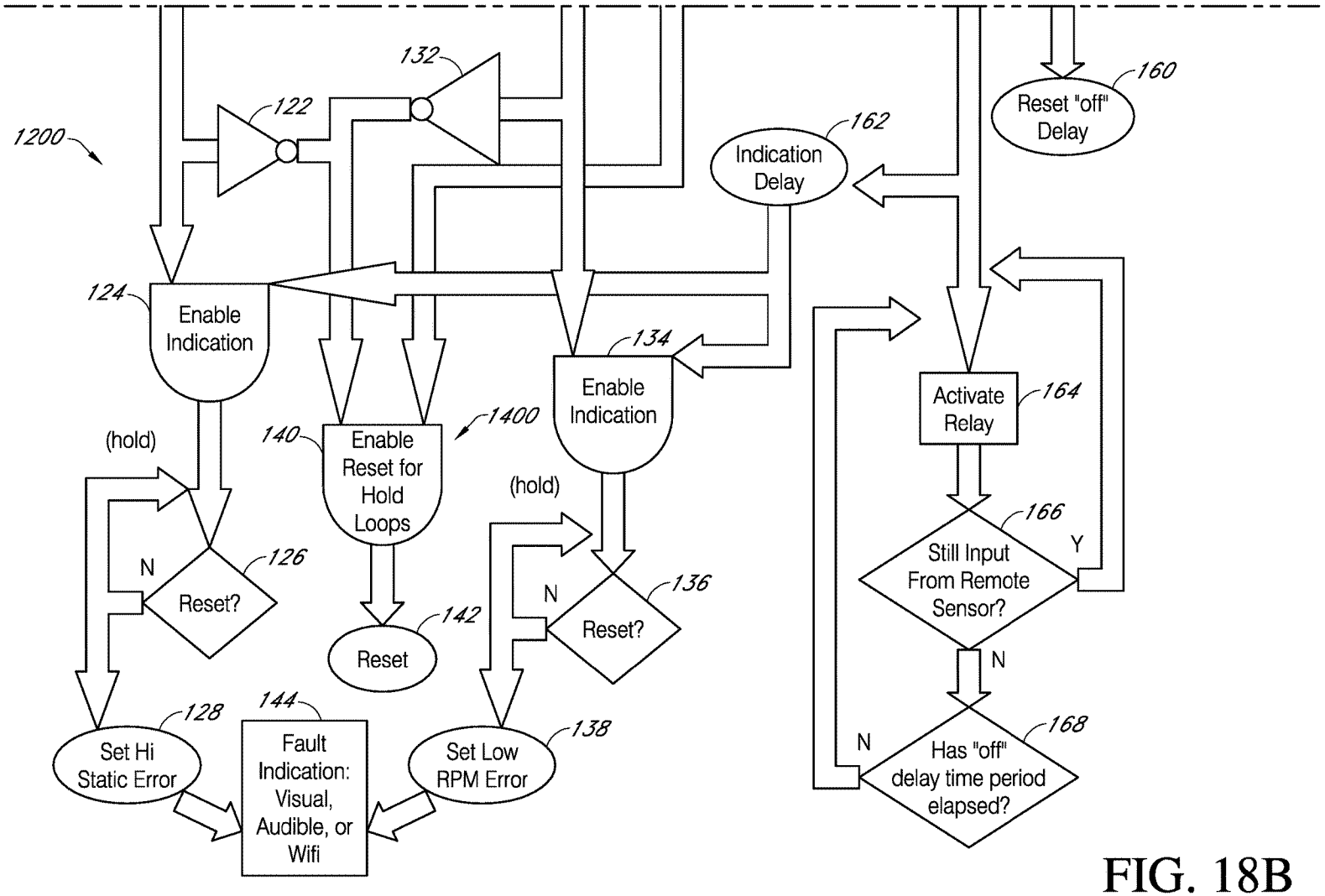
FIG. 18 is a flow chart of an embodiment of the present invention, which could be implemented using the circuit of FIG. 17.

Now referring to the drawings wherein like numerals refer to like structure shown in the drawings and text included in the application throughout. With reference to FIG. 17, there is shown a new and useful DEDPV control circuit generally designated 100. The system includes numerous sub-sections, which are shown in enlarged detail in FIGS. 1-16. FIG. 18 is a higher-level flow diagram directed toward the embodiment of FIG. 17.

Figure 1:
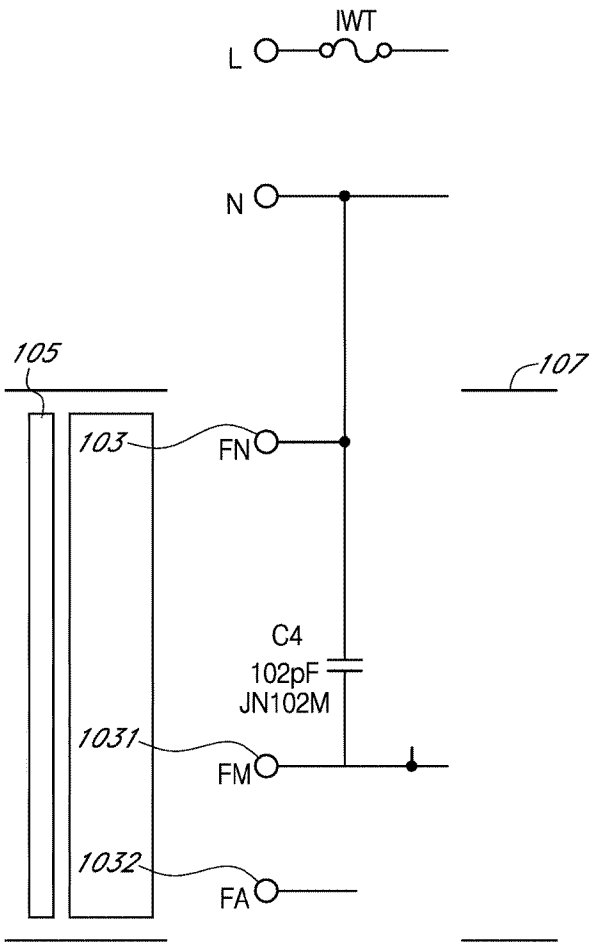
FIG. 1 is an enlarged view of a representative portion of the circuit of FIG. 17.
Figure 22:
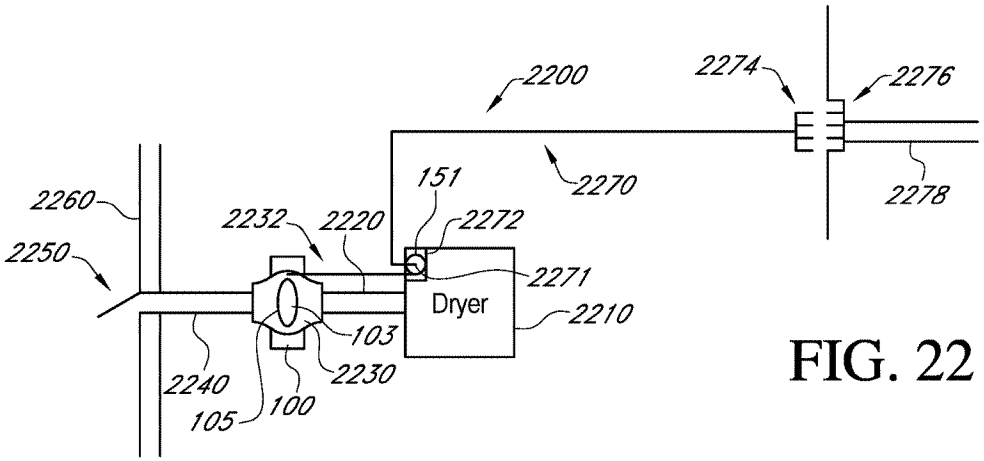
FIG. 22 is a simple system diagram of an embodiment of the present invention as shown in FIGS. 1-18.

Now referring first to FIGS. 1, 18 and 22, there is shown a DEDPV generally designated 2200 (FIG. 22) and DEDPV control circuit 100 (FIG. 22 and FIG. 18) which describes just one particular embodiment of the many embodiments of the present invention. This particular embodiment is focused on a DEDPV with the capability of multiple error indications as well as compensation for input power line fluctuations. The DEDPV includes a centrifugal duct fan and a DEDPV control circuit 100 which includes several subsections, which are shown in FIG. 18 and will be discussed in depth below. The subsections include, but are not limited to, means for determining a difference in winding voltages 101, means for detecting a high static pressure in a duct 1200, means for detecting a low booster fan RPM 1300, means for enabling reset of held indications 1400, and means for detecting dryer current 1500. Instead of using a dedicated pressure sensor, a hall effect sensor, or an RPM sensor to indirectly determine high static pressure during the operation of the DEDPV, the internal pressure in the DED 2220 and/or distal DED 2240 (FIG. 22) is determined using the rotation rate of the air movement inducing element 105 (fan) coupled to electric motor 103 (FIGS. 1 and 22). Electric motor 103 may be a permanent split capacitor (PCS) motor. The rotation rate is determined by correlating the changes in voltage on the auxiliary winding 1032 (FIG.1) with the RPMs of the electric motor 103, while knowing the performance characteristics of the air movement inducing element 105. No hall effect sensor is needed, nor is there any need for any structure for counting the rotation of the impeller as it turns. In one embodiment, the invention will be free of all hall effect sensors and all sensors designed to observer the rotation of the impeller or any fan portions. A complete understanding of this embodiment can be obtained by referring to FIG. 18 in conjunction with FIGS. 1-16, and 17, and their associated text. The discussion of FIG. 18 is intended to provide an overview of the vast detail provided in FIGS. 1-17.

More specifically referring now to the details of FIG. 18, means for determining a difference in winding voltages 101 includes electric motor main winding voltage sensor 102, which is sensed here so as to remove uncertainty caused by variations in the input voltage from the house wiring 2278 (FIG. 22). Voltage divider/transformer 106 is used to provide a rectifying of the signal from electric motor main winding voltage sensor 102 and a positive bias to facilitate consistent measurement. Electric motor winding voltage sensors 102 and 104 can be any suitable components which function as a voltage detector or voltage measurement device. The rotation rate of the electric motor 103 is determined by the electric motor auxiliary winding voltage sensor 104, which is an input to voltage divider/transformer 108, which provides a rectifier 112 function and an input into winding voltage difference amplifier 114, which is easily compared to the main winding voltage signal 110. The output of winding voltage difference amplifier 114 is directed to winding voltage signal difference signal line 116, which is provided to high static condition comparator 120, low RPM condition comparator 130 and optionally to optional analog output 118. High static condition comparator 120 compares the signal corresponding to the output of electric motor auxiliary winding voltage sensor 104 with the high static set point input 121. The output of high static condition comparator 120 is input into high static condition enable indication block 124 and into diode 122. Similarly, electric motor 103 compares the low RPM set point input 131 to the winding voltage signal difference signal line 116 and provides it to low RPM enable indication block 134 and diode 132. The output of diodes 122 and 132 is provided to block 140 and to reset 142. Indication delay 162 provides input to both high static condition enable indication block 124 and low RPM enable indication block 134, whose outputs are provided to high static condition indication reset 126 and high static error signal 128 and to low RPM indication reset 136 and low RPM error signal 138, respectively. Depending upon the desired form of the indication, block 144 will provide a visual, audible, WIFI or other signal for indication to the dryer user. Means for detecting a high static pressure in a duct 1200 and means for detecting a low booster fan RPM 1300, in combination, create a windowed passage such that no indication is generated if the RPM of the electric motor 103 falls between the upper limit set by high static set point input 121 and the lower limit set by low RPM set point input 131. In some embodiments, a signal above high static set point input 121 will result in a rapid blinking LED, while a stopped rotor or a low RPM below the low RPM set point input 131 will result in a slow blinking visual indication. Other forms of indication are possible and may be preferred in certain applications.

Means for detecting dryer current 1500 includes remote sensor 151, which could be the SCT-013 clip on current sensor by YHDC company, with the output signal being rectified by rectifier 152. Dryer current sensor to DEDPV communication link 2232 (FIG. 22) would communicate the information from remote sensor 151 before rectifier 152. The rectified output of remote sensor 151 is compared by comparator 156 to dryer current threshold 154, which may be a fixed for any particular model of dryer but adjusted across a line of dryers which may have different current usage profiles. Time delay parameter 158 provides for a delay in starting the electric motor 103. The output of time delay parameter 158 is provided to block 140, reset off delay 160 indication delay 162 and to activate relay 164. Further control is provided by block 166 and block 168.

Figures 19, 19A, 19B:
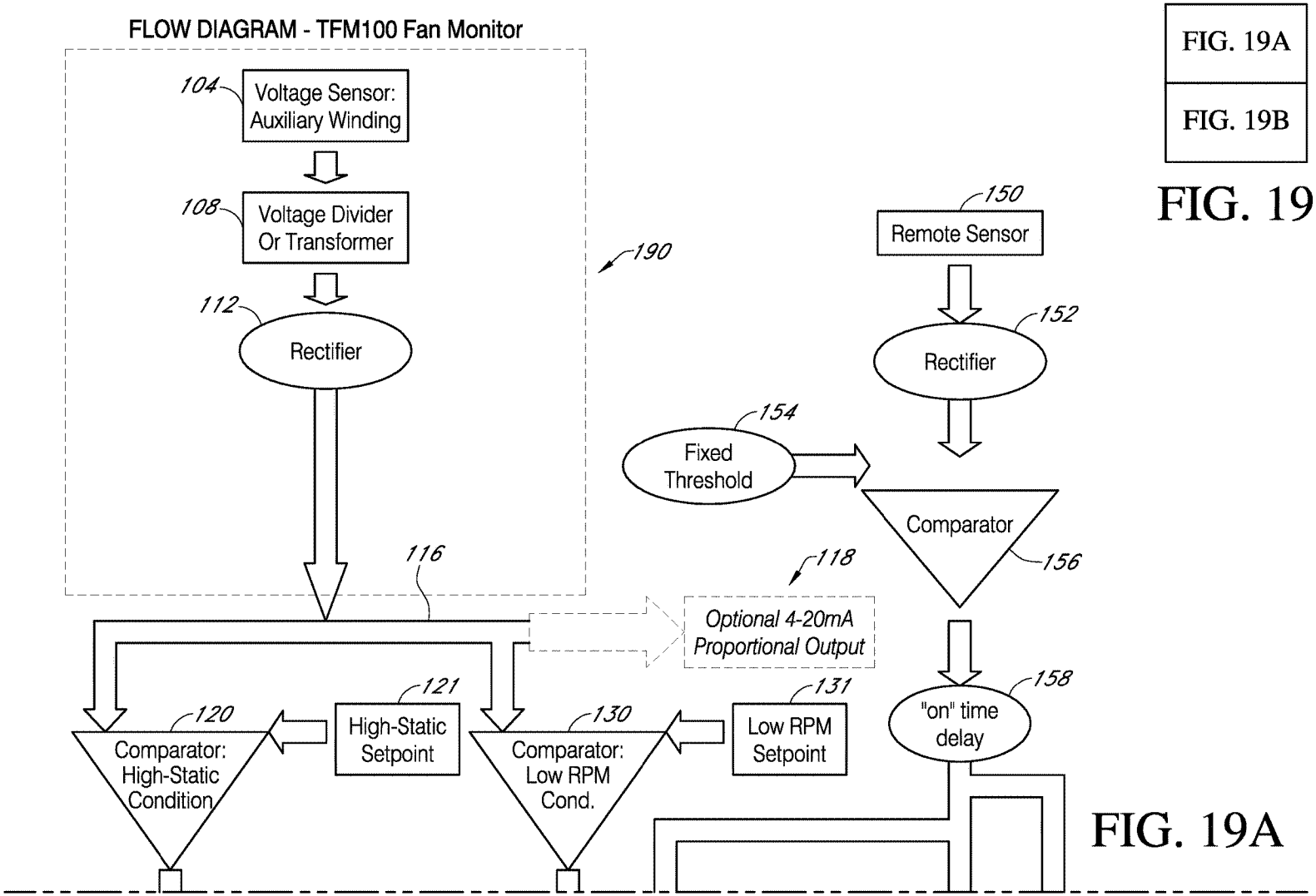
FIG. 19 is a variation of the embodiment of FIG. 18.
Figure 19B:
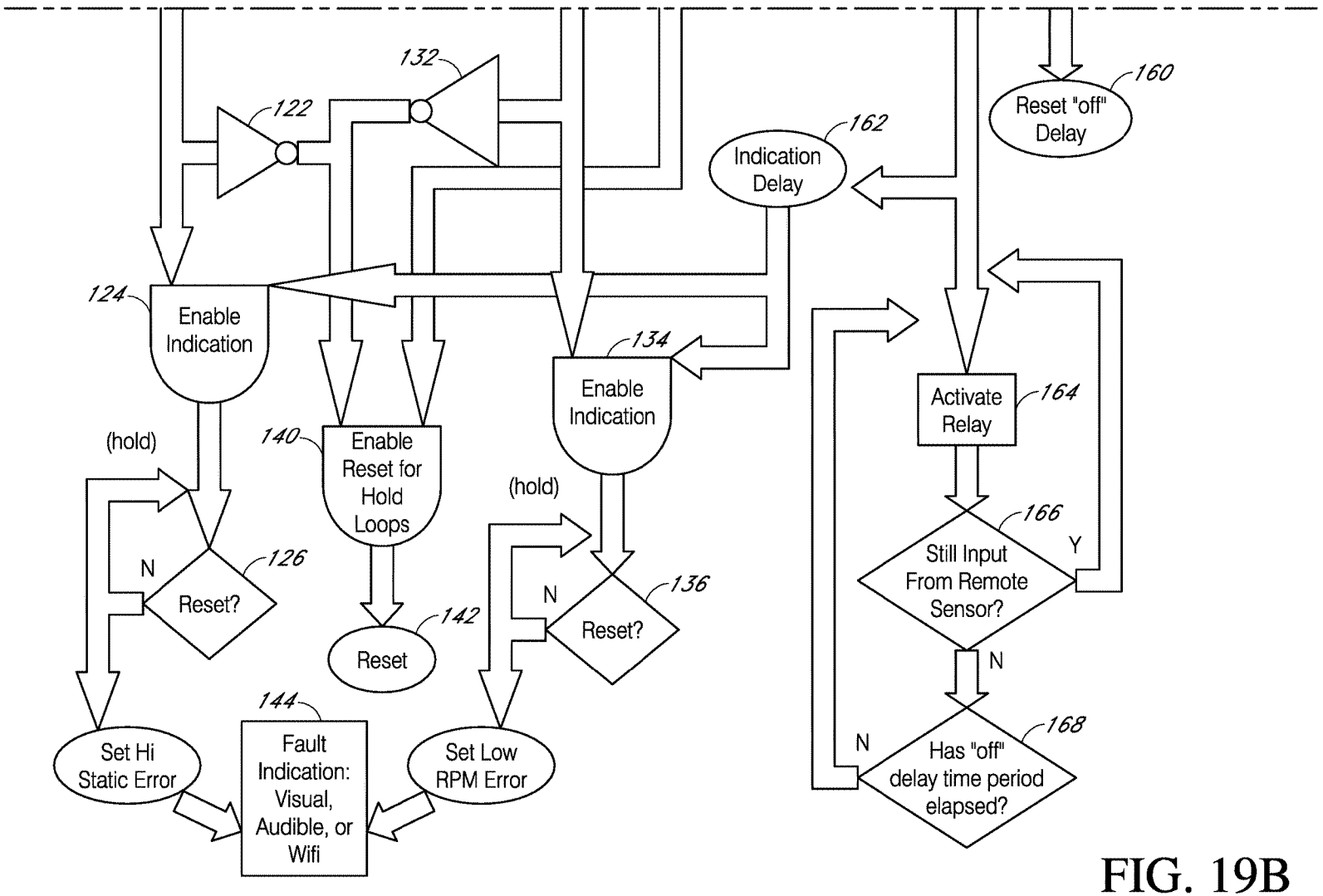

Now referring to FIG. 19, there is shown a variation of FIG. 18 where there is no compensation made for fluctuations in house wiring 2278. Means for conditioning auxiliary winding voltage signals 190 is provided directly to winding voltage signal difference signal line 116 without the benefit of electric motor main winding voltage sensor 102 and its information. Otherwise, the performance and operation are similar to the embodiment of FIG. 18.

Now referring to FIG. 22, there is shown an overview of the system of the present invention, which included dryer 2210, DED 2220, DEDPV 2230, distal DED 2240, dryer vent 2250, exterior of building 2260, dryer power connection compartment 2272, which is located on the back side of dryer 2210, dryer current sensor to DEDPV communication link 2232, air movement inducing element 105, electric motor 103, DEDPV control circuit 100, dryer power cord 2270 which at its dryer end includes power lead wire 2271 inside of dryer power connection compartment 2272. Dryer power cord 2270 includes dryer power cord terminal plug 2274, which plugs into dryer cord power plug receptacle 2276, which is a part of house wiring 2278.

Figure 23:
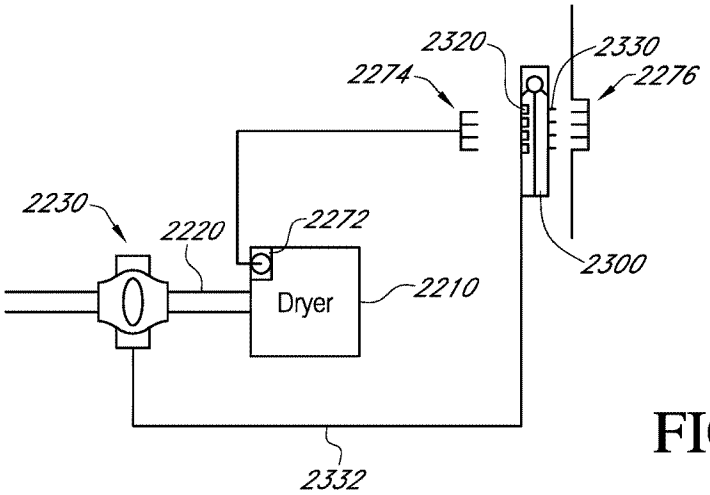
FIG. 23 is a variation of the embodiment of FIG. 22.

Now referring to FIG. 23, there is shown a variation of the system of FIG. 22 where the current sensor is shown as plug and play dryer current sensor 2300, which is disposed between the dryer power cord terminal plug 2274 and the dryer cord power plug receptacle 2276. Dryer power cord terminal plug 2274 plugs into plug and play receptacle 2320 and the plug and play plug 2330 plug into the dryer cord power plug receptacle 2276. The current is sensed and a signal is communicated back to DEDPV 2230 via dryer current sensor to DEDPV communication link 2332. In this variation, there is no need to access the dryer power connection compartment 2272 when installing the DEDPV. In a variation of this system, the plug and play current sensor 2300 could have an interlocked DEDPV power receptacle into which a DEDPV is plugged in to receive power.

Figure 20B:
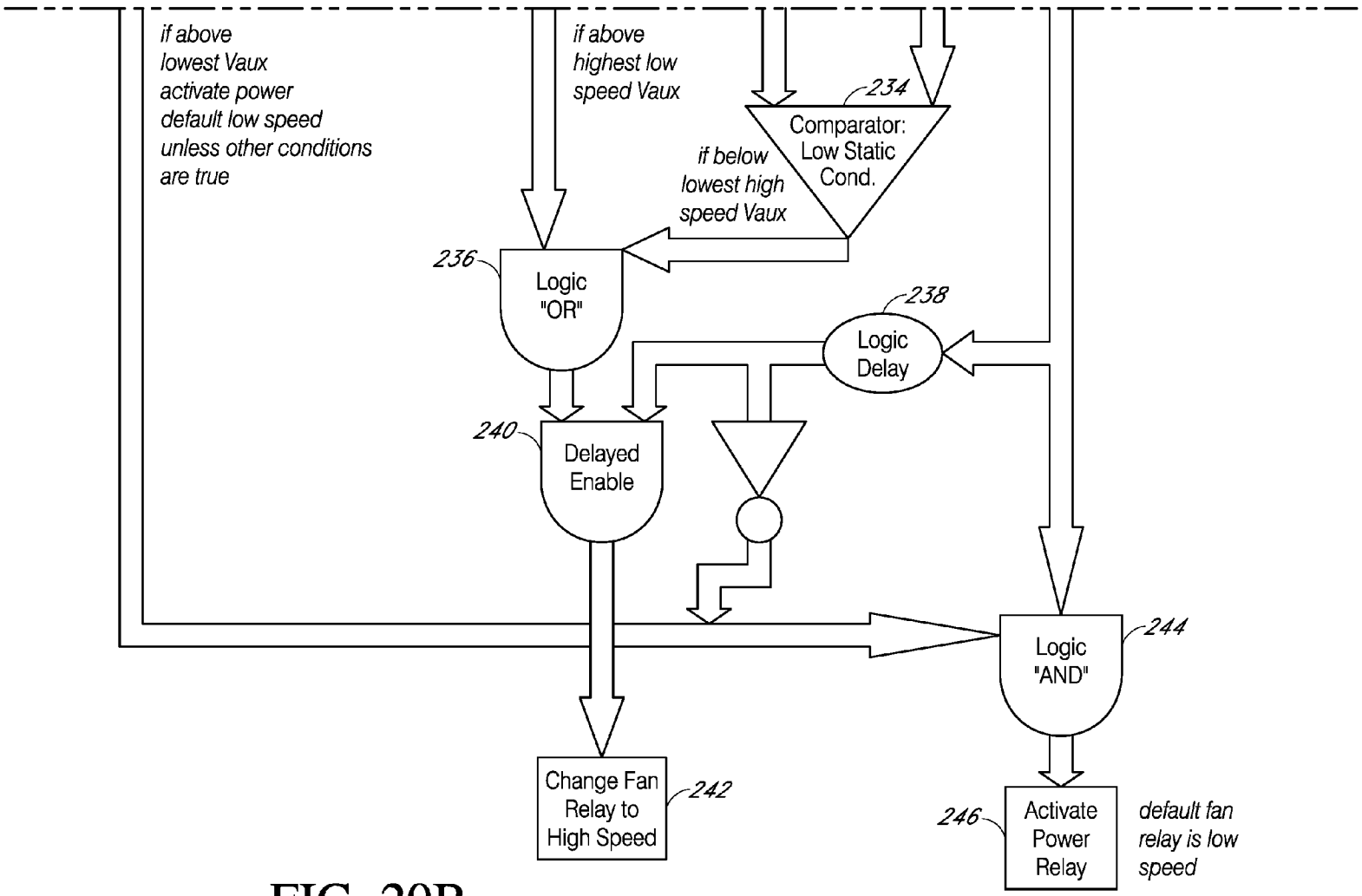
FIG. 20 is an alternate embodiment of the present invention, which includes much of the structure and functionality of the embodiment of FIG. 18.
Figures 21, 21A, 21B:
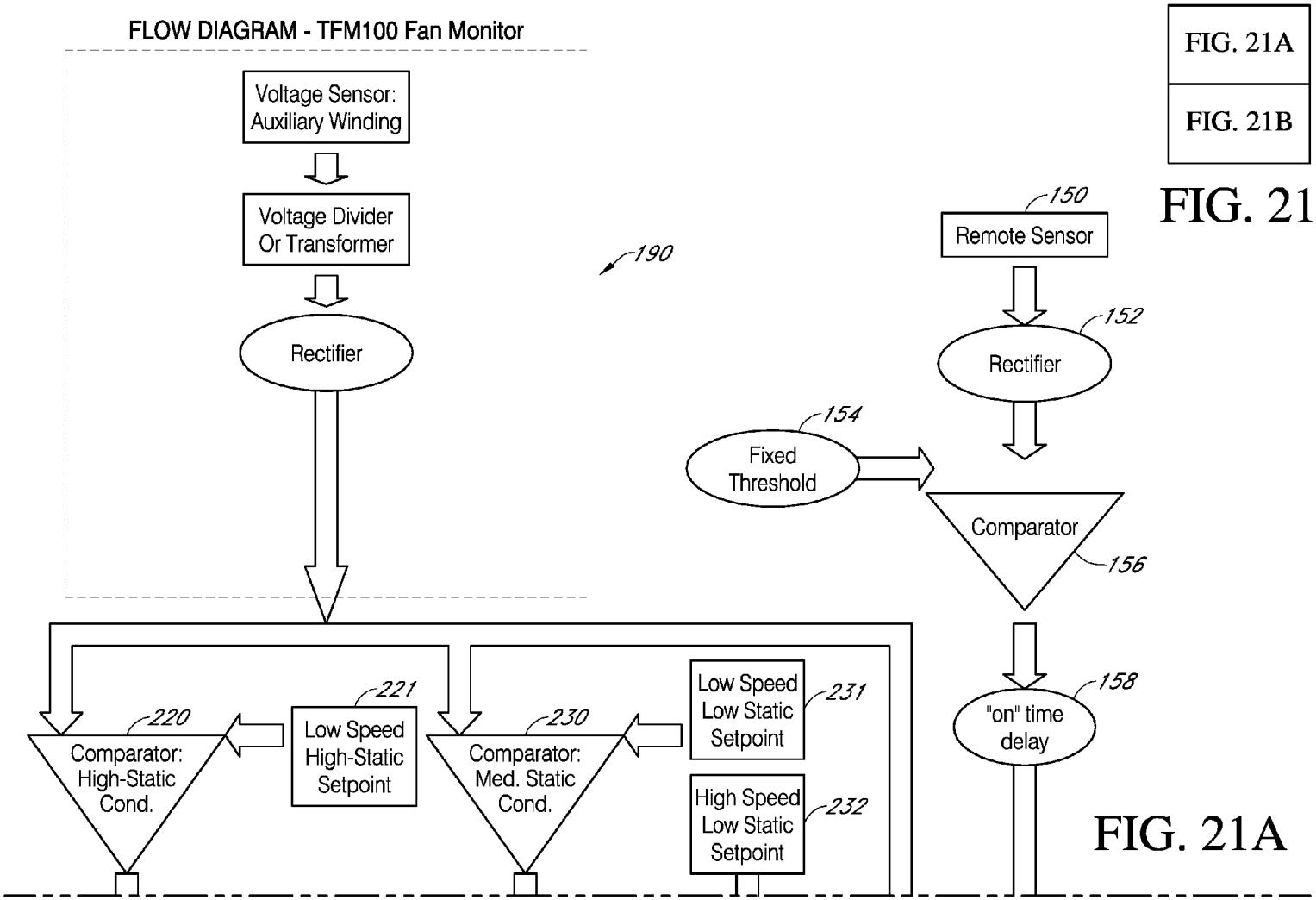
FIG. 21 is a variation of the embodiment of FIG. 20.
Figure 21B:
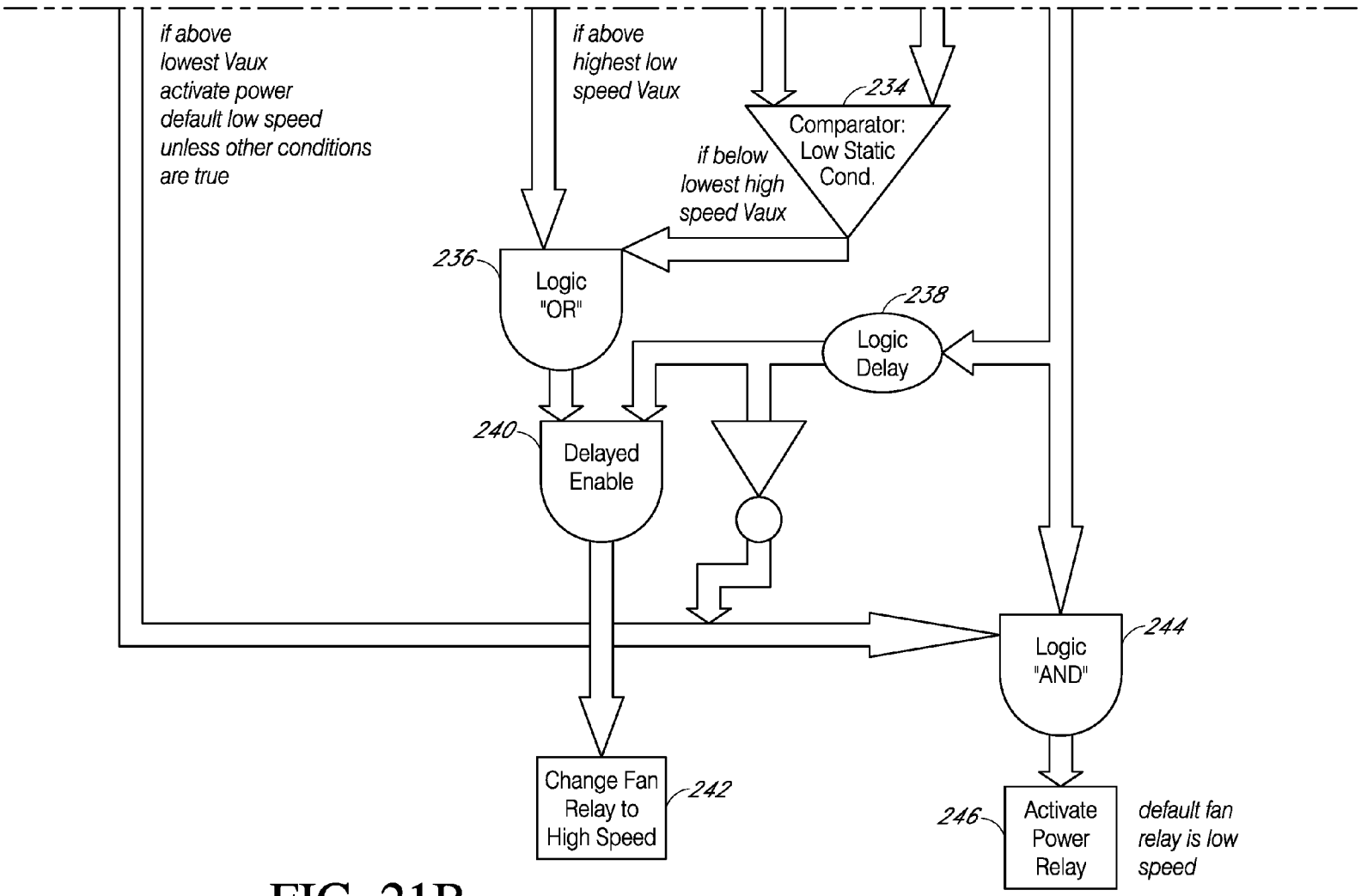

Now referring to FIG. 20, there is shown a variation of the system of FIG. 18, which is a general power ventilator having an automatic fan speed selection based upon the static pressure in the duct for the purpose of maintaining constant air velocity through the duct. FIG. 21 is to FIG. 20 as FIG. 19 is to FIG. 18. The following description in this paragraph applies equally to FIGS. 20 and 21. The output of winding voltage difference amplifier 114 is provided to high static condition comparator 220, medium static condition comparator 230, and low static condition comparator 234, which it is compared to low speed high static set point 221, low speed low static set point 231, and high speed low static set point 232, respectively. The outputs of medium static condition comparator 230 and low static condition comparator 234 are both provided to "OR" logic 236, while the output of high static condition comparator 220 is provided directly to logic AND block 244. Time delay parameter 158 provides its output to logic delay 238 and to logic AND block 244. Logic delay 238 proves its output to logic AND block 244 (through a diode) and to delay enable 240, which also receives an output from "OR" logic 236. The output of delay enable 240 is provided directly to block 242. The output of logic AND block 244 is to activate power relay block 246.

Now referring to FIGS. 17 and 1-16, the details of one embodiment of the present invention are shown.

FIG. 1 shows the line voltage connections are made via lead wires soldered to pads on the circuit board. The supply power is connected to the L and N pads. L is for the "hot" wire and N is for the "neutral" wire. The L pad is connected across an intentionally weak trace on the board to serve as a 5 amp fuse for both the circuit and connected fan. Additional protective devices are included in other sections of the circuit.

The controlled/monitored fan is connected to the Fn, Fm, and Fa pads. The Fn is for the fan neutral and is directly connected to the supply N pad. The Fm pad is for the fan main winding. Pad Fm receives switched power from a relay. The relay contacts are normally open and powered by a connection to the L pad (after the IWT). Capacitor C4 is connected across the Fm and Fn pads. Finally, the Fa pad is for the fan auxiliary winding. Both the Fm and Fa pads send voltage to a detector circuit for monitoring fan conditions.

Figure 2:
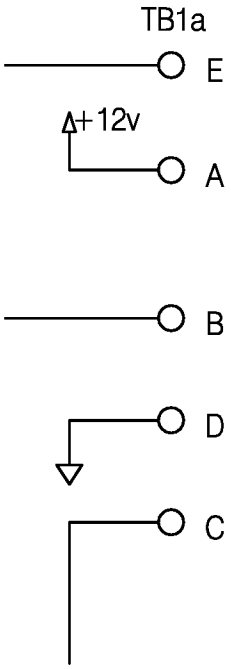
FIG. 2 is an enlarged view of a representative portion of the circuit of FIG. 17.

FIG. 2 shows TB1*a* is a 5-position terminal block with 5 mm side-entry terminals. Terminal A is directly connected to the power supply. For the TFR100 board, this is used to power the red "fault" LED when the current sensor is unplugged. This 12V supply can also be used to power additional sensors besides the current sensor to actuate the fan relay. The sensor should have a maximum current draw of 40 mA. Terminal B provides switched 12V for the green LED on the TFR100 board. It is connected to the output of the U1*c* operational amp that also actuates the relay for the fan.

Terminal C provides switched 12V for the red LED on the TFR100 board. It is connected to the output of the U3*c* op amp that sets the blinking rate of the LED. Terminal D is connected to ground. It provides the ground to both LED's on the TFR100 board. It also ties terminal E to ground (via the TFR100 board) when the current sensor is unplugged to help keep the input of U1*b* low when not in use. Terminal E receives the sensor signal from the TFR100 board. It is connected to the input of U1*b*.

Figure 3:
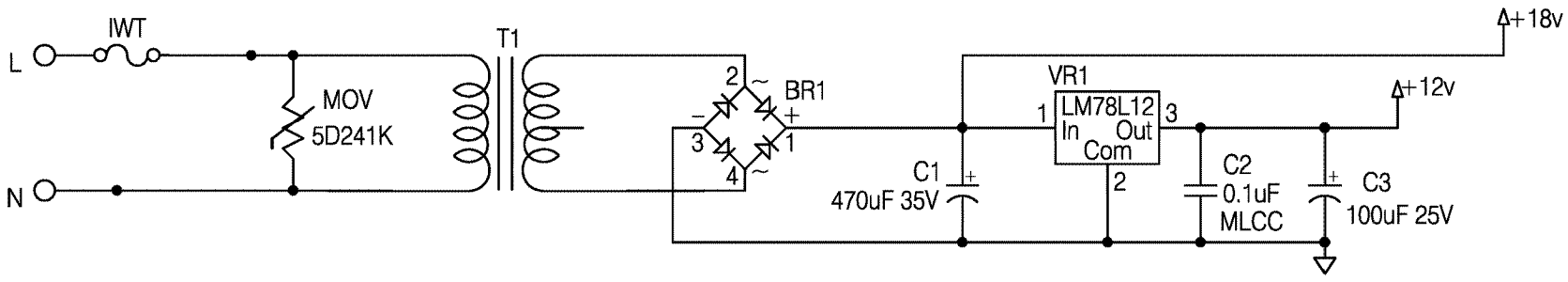
FIG. 3 is an enlarged view of a representative portion of the circuit of FIG. 17.
Figure 4:
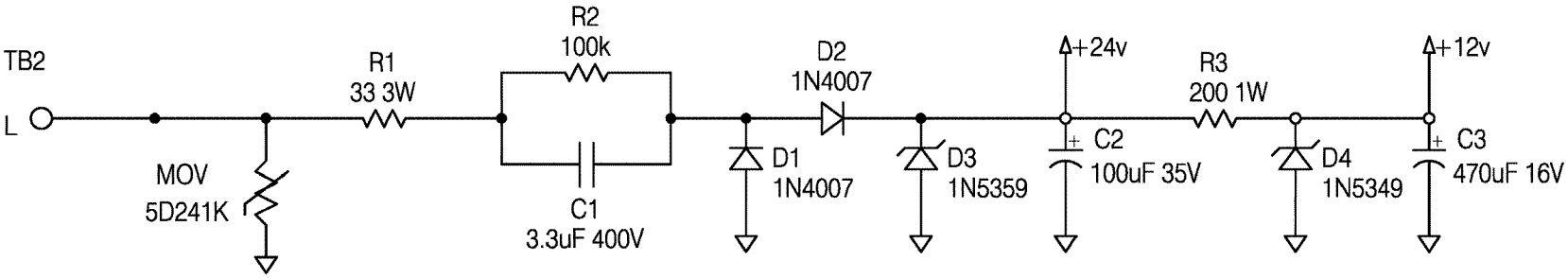
FIG. 4 is an enlarged view of a representative portion of the circuit of FIG. 17.

FIG. 3 shows the power supply is first fused via an intentionally weak trace (IWT) or a 5 amp fuse. It also has an MOV protecting the transformer. The transformer T1 has a 120V primary and a 12V secondary rated between 70 mA and 100 mA. The design current is 68 mA. The transformer secondary output is rectified to a DC voltage via BR1 bridge rectifier. C1, a 470 μF electrolytic capacitor, is used to reduce the ripple voltage. It is rated at 35V, or twice the input voltage present from BR1. An 18V unregulated DC supply is taken from the positive side of this capacitor to serve as the relay coil supply voltage. After the C1 has smoothed the DC voltage from BR1, the supply is fed through a voltage regulator IC LM78L12. This regulator was chosen for its small TO-92 package and maximum output current of 100 mA. C2, a 0.1 μF ceramic (or MLCC) capacitor reduces the high frequency ripple at the output of VR1. C3, a 100 μF electrolytic capacitor, serves as a reservoir for voltage changes to the supply circuit imparted by the blinking error indicator diode. After C3, a steady 12V voltage is present for all other components in the circuit.

Figure 5:
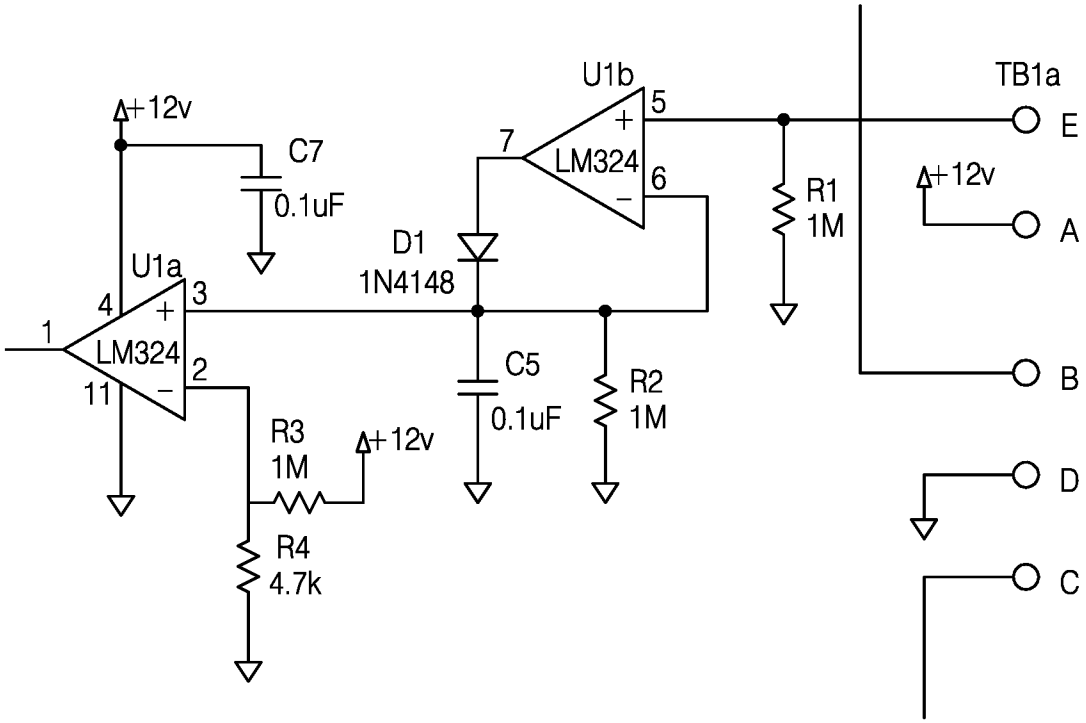
FIG. 5 is an enlarged view of a representative portion of the circuit of FIG. 17.

FIG. 5 shows Op amp U1 is an LM324 quad operational amplifier. Voltage on terminal E is detected via the non-inverting input of U1*b*. A 10kO resistor, R1, ties this input to ground when there is no connection on terminal E. U1*b* is constructed as a precision rectifier via 1N4148 diode D1 and 0.1 μF capacitor C5. In this configuration, U1*b* will output a DC voltage to the next stage equal to the positive peak voltage present on the non-inverting input. R2 is a 1MO bleeder resistor that will discharge C5 when the rectifier input goes low. The next stage, U1*a*, is configured as a comparator. The non-inverting comparator input is fed by the previous stage. The inverting comparator input is fed a 55 mV voltage via the voltage divider formed by R3 (1MO resistor) and R4 (4.7kO resistor). Whenever the voltage at the non-inverting input (output from precision rectifier U1*b*) is greater than the voltage on the inverting input (55 mV threshold), the output of the comparator will swing high to the 12V supply voltage. It is not necessary to add hysteresis to the comparator since it is always receiving a smooth rectified input. It was determined experimentally that the internal noise of U1*a*, U2*b* is equal to 27 mV with no input from terminal E. The 55 mV threshold was designed to be twice the noise floor.

The current sensor used for this circuit is model SCT-013-050. Within the remote indicator panel circuit (TFR100), the output of the current sensor is connected to terminals E and D (ground). The current sensor will output an AC sine wave voltage that is proportional in amplitude to the sensed current. It was determined experimentally that it will output approximately 90 to 110 mV when sensing a typical dryer motor fan current. The current sensor will output the minimum 55 mV when sensing approximately 0.75 A with 3 turns of wire around the current sensor core.

The possibility of expansion is included in this detector circuit. It is designed to receive an AC input of less than 1 volt (from the passive current sensor). However, when the rectifier stage receives a DC input signal, the comparator will function in the same way as an AC signal input. Since the circuit will output 12V via terminal A, any passive or active detector that will return a DC voltage between 0.055 and 12.0 volts to terminal E can be used to activate the TFM100. An active detector should have a buffered output.

Figure 6:
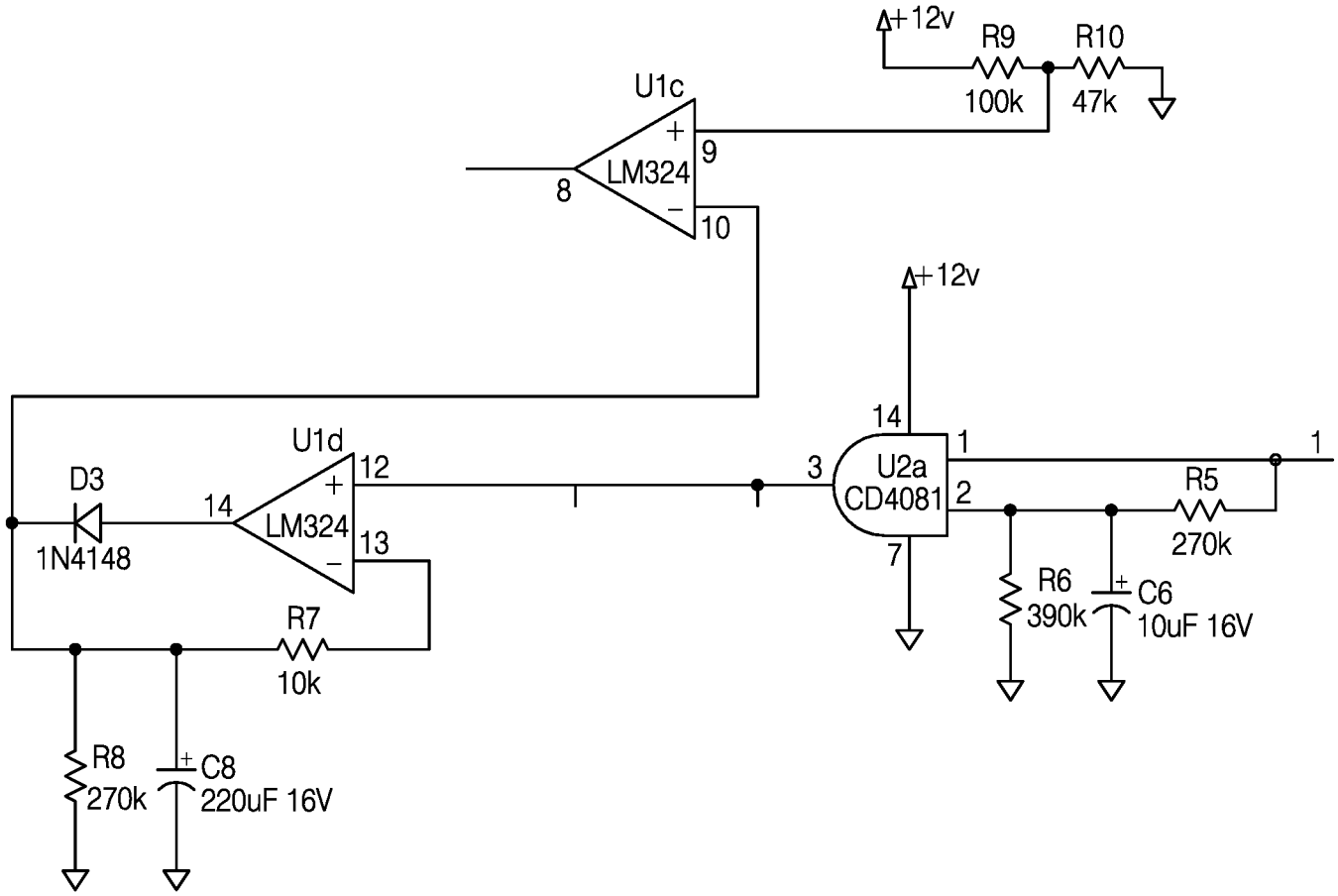
FIG. 6 is an enlarged view of a representative portion of the circuit of FIG. 17.

FIG. 6 shows the output of comparator U1*a* is fed to the first gate of U2. U2 is a CMOS quad AND gate CD4081. Gate U2*a* provides the "delayed on" behavior for the fan relay timing. This is needed to prevent transient surges at the current sensor from inadvertently activating the fan relay. When U1*a* output goes high, it is fed directly to pin 1 of the U2*a* AND gate. It is also fed to pin 2 via an RC circuit comprised of 270kO resistor R5 and 10 μF electrolytic capacitor C6. This will delay the voltage rise on pin 2 for a period of time. The AND gate needs a logic "high" at both input pins before swinging the output high. It will take the RC circuit R5/C6 roughly 2.5 seconds to reach the lower threshold of the CD4081 logic "high". This will ensure that the fan relay does not turn on unless the current sensor is sensing a constant current for more than 2.5 consecutive seconds. R6 is a 390kO resistor connected across C6. It will bleed the capacitor once the U1*a* output goes low (current sensor stops sending voltage). The reality is that R5 will also bleed capacitor C6 when U1*a* goes low, but we need this to happen quickly to bring U2*a* to a "low" logic state. R6 is sized to minimize the bleed time of C6 without impacting the gate logic for U2*a*. Since R5 and R6 form a voltage divider, the 7.09 volts at pin 2 is enough to keep pin 2 of U2*a* at logic "high" when C6 is charged.

Figure 7:
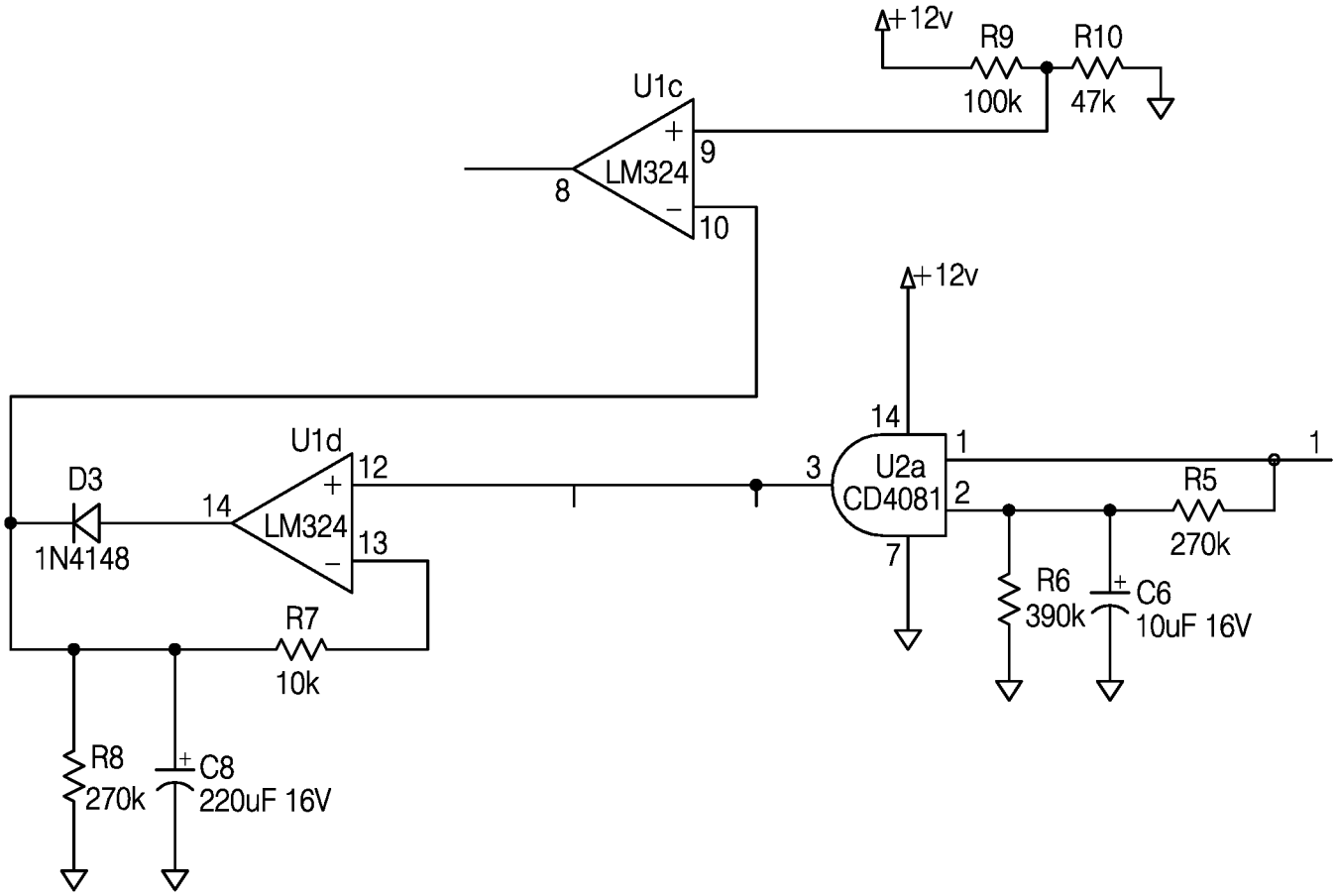
FIG. 7 is an enlarged view of a representative portion of the circuit of FIG. 17.

FIG. 7 shows the next stage of op amp U1*d* is configured as a peak detector. Once U2*a* goes high (following the 2.5 second "on" delay), 12 v is present on the non-inverting input of U1*d*. U1*d* will keep the voltage on capacitor C8 at 12V while U2*a* is outputting a logic "high". C8 is a 2200 electrolytic capacitor. R8 a 47kO, resistor, is connected across C8. Once the input cycle stops and U2*a* goes low, 1N4148 diode D3 will prevent U1*d* from discharging the capacitor. The capacitor can only discharge via R8. This discharge cycle forms the "off" delay of the circuit. The voltage on capacitor C8 is fed to the last stage of op amp U1. U1*c* is configured as a comparator. The non-inverting input is fed by the previous peak detector stage. The inverting input is fed by the R9/R10 voltage divider. R9 (100kO) and R10 (47kO) establish the 3.84V threshold for the comparator. When U2*a* goes "high" (12V output), U1*d* immediately outputs 12V via C8 to the comparator's non-inverting input and the comparator outputs 12V to the relay stage. So the relay will turn on immediately following the 2.5 second "on" delay established by U2*a*. Once the input cycle stops and U2*a* goes "low" (0V output), the C8 capacitor begins to discharge via R8. The voltage at C8, and subsequently at the non-inverting input of U1*c*, will eventually drop below the 3.84V threshold after approximately 10 seconds. Comparator U1*c* will go low, turning off the relay. This establishes the 10 second "off" delay for the relay.

In the instance that the circuit is performing the "off" delay (C8 discharging after input stops) and again receives input from the sensor (after a 2.5 second delay), U1*d* will immediately reset the "off" delay to 10 seconds by charging C8 back to 12 volts.

In other iterations of this sensor/relay circuit (ie: stand-alone sensor/timer control), R8 values of 22kO, 270kO and 680kO give "off" delays of approximately 5 seconds, 1 minute and 5 minutes respectively.

Figure 8:
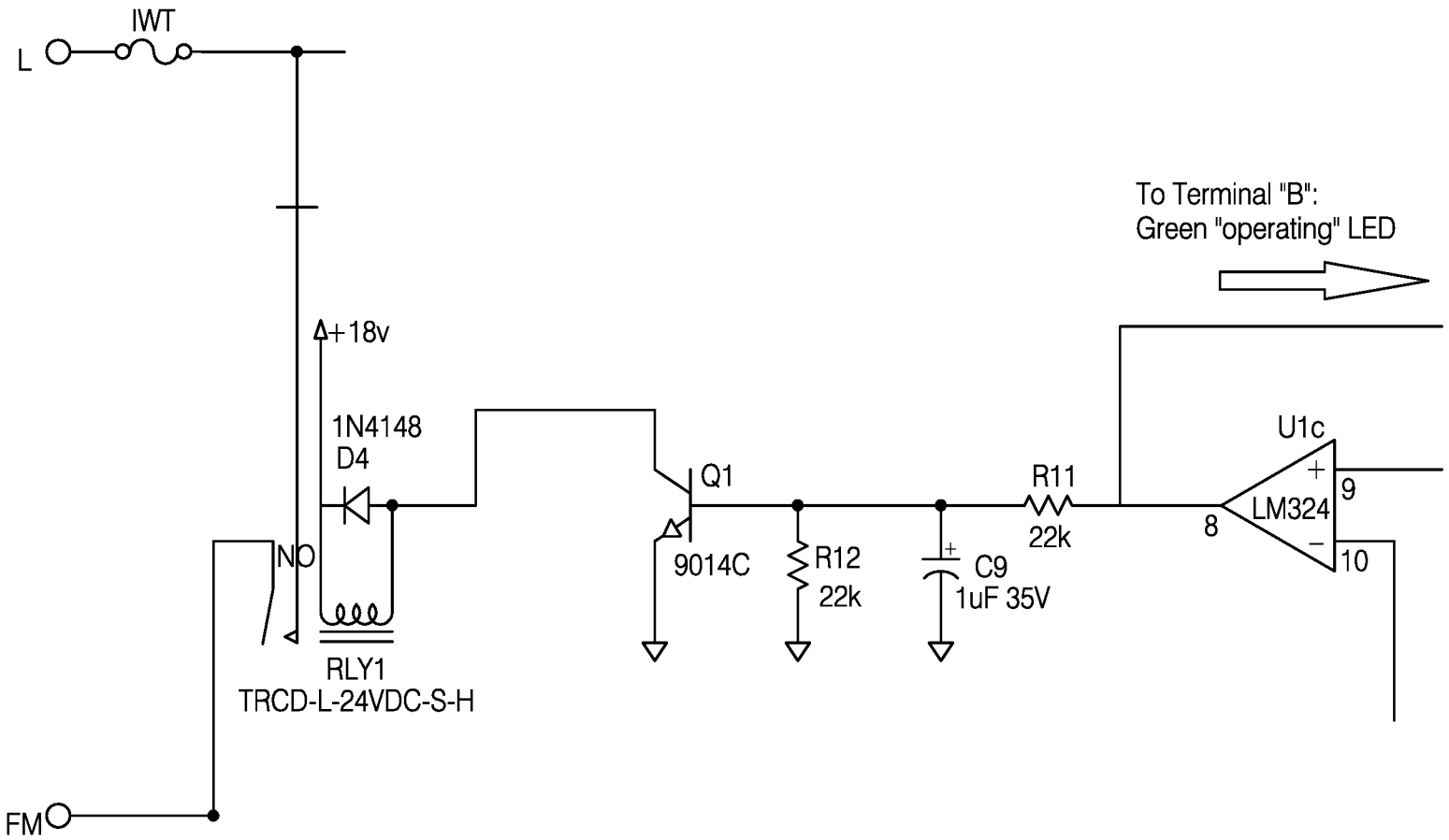
FIG. 8 is an enlarged view of a representative portion of the circuit of FIG. 17.

FIG. 8 shows when the output of U1*c* is high, the output drives the green LED (through a 1kO resistor) on the TFR100 via terminal B. The output of U1*c* is fed to the base of the transistor through R11, which is a 22kO current limiting resistor. Transistor Q1 is a 9014C NPN. The transistor will sink the relay coil current from the +18V supply to ground when activated. The relay is a model TRCD-L-24VDC-S-H. Per the manufacturer's data sheet, the relay coil is 2880O and has an operating voltage of 18 VDC. So the collector current, Ic in the Q1 transistor, is 6.25 mA when activated. The current limiting resistor is 22kO, so the base current is equal to (12V−0.7V)/22000 or 0.51 mA. This gives an HFE over 10, which is suitable for switching. Electrolytic capacitor C9 is rated at 1 μF and is connected across the Q1 base and ground. Together with R11, this capacitor creates a time constant (r) of 22 ms. This helps remove jitter from the relay coil. The 22 ms time constant also serves to aid in the initial reset logic for the sample and hold circuit described in a later section. R12, another 22kO resistor, is also placed across the Q1 base and ground. This resistor adds stability by ensuring that the transistor base stays grounded when off. Typically, this resistor should be ×10 the value of the base current resistor (R11). But at 22kO, it discharges the capacitor quickly when off and doesn't present any operational problems when the transistor is on. A 1N4148 diode D4 is reverse biased across the relay coil. This "flywheel diode" protects the circuit from the large voltage spike generated by the collapsing relay coil field whenever the relay de-energizes.

It is important to limit the current to the LED on the remote TFR100 board. With a 1kO resistor, the LED current is 10 mA. Together with the Q1 base current of 0.51 mA, the 10.51 mA total current sourced by the output of U1*c* is well below the 20 mA maximum for this LM324 IC. The maximum safe current through the LED using standard resistor values could be 17.9 mA. If the LED intensity needs to be increased, the current limiting resistor on the LED could be as low as 560O.

Figure 9:
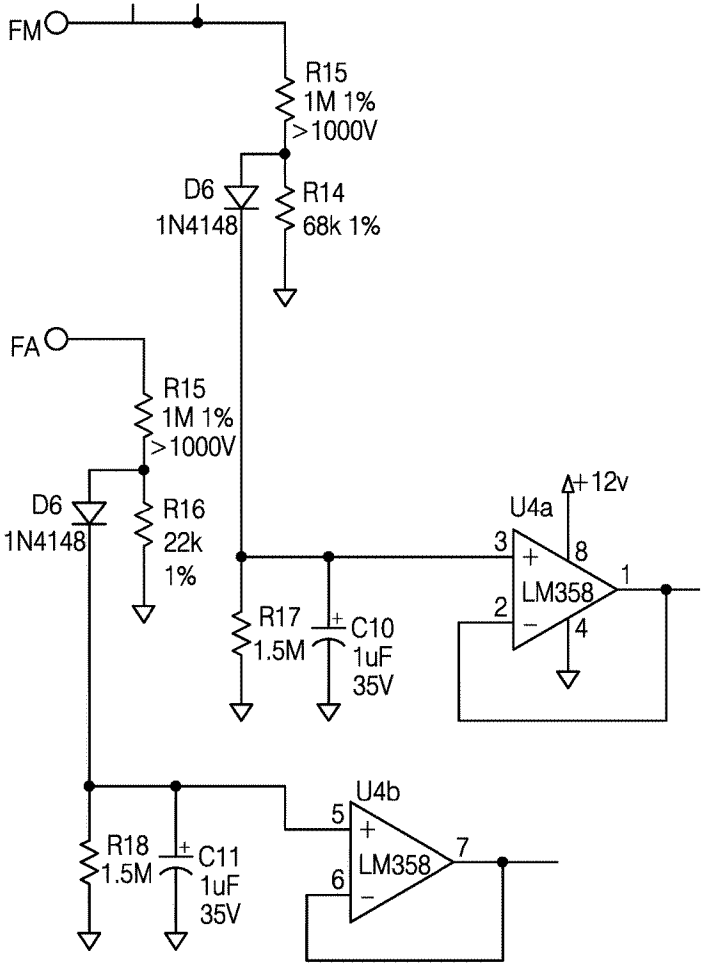
FIG. 9 is an enlarged view of a representative portion of the circuit of FIG. 17.

FIG. 9 shows the detection circuit is designed for a permanent split-capacitor (PSC) fan motor. The Fm pad is connected to the fan main motor winding. The Fa pad is connected to the fan auxiliary motor winding. Internal to the fan, the starting capacitor is ultimately connected across Fm and Fa. The voltage present at the Fm pad should always be equal to the supply line voltage (unless the fan's thermal fuse is tripped). The voltage present at the Fa pad varies. When the fan RPM is low (starting or locked rotor conditions), the voltage across the auxiliary winding is lower than the main's voltage. When the fan is running at design RPM, the voltage across the auxiliary winding should be close in magnitude to the main winding, provided that the fan capacitor is correctly sized. When the fan encounters a high-static pressure condition, the voltage across the auxiliary winding will exceed the main's voltage. The extent of this voltage differential depends on the difference in coil resistances between the main/auxiliary windings, and also whether or not the fan capacitor is properly sized for the application.

The circuit will measure the voltage differential between these two windings and use this information to indicate error conditions as they arise.

The fan main motor winding voltage present at pad Fm first goes to a voltage divider formed by resistors R13 and R14. R13 is a 1MO resistor and R14 is 68kO. Both resistors have a 1% tolerance. R13 has a voltage rating 2: 1000V. High resistances are chosen to keep the current and thus power dissipation low. With a 120V AC voltage at pad FM (169.71V Peak-Peak), there will be approximately 7.75V P-P at the junction of R13 and R14. This is fed through 1N4148 diode D5 to provide half-wave rectification. Once this voltage is passed across electrolytic capacitor C10 (1 μF), a smoothed and rectified DC voltage is available for measurement in later stages of the circuit. Resistor R17, a 1.5MO resistor, is connected across C10 to bleed the voltage when no input voltage is present at the input pad Fm. Finally, this voltage is fed to a buffer (voltage follower) formed by U4*a* which is ½ of the LM358 operational amplifier. This will ensure a high input impedance for the differential amplifier in the next part of the circuit. The fan auxiliary winding voltage present at pad Fa is treated separately but in similar fashion with the following components: R15, R16 (22kO), D6, R18, C11, and U4*b*.

An earlier iteration of this circuit only measured the voltage at the auxiliary winding to determine fault conditions. This topology would not properly handle fluctuations in the main's supply voltage. These small DC rectified voltages from the detector circuit will always be in proportion to the mains voltage. Comparators will be used to see if these detected voltages exceed or fall below the threshold voltages (settings) that are used. But voltage thresholds set on comparators are in reference to the tightly-regulated 12V supply voltage, which will remain constant even as the main's voltage fluctuates. So instead, the circuit must measure the difference between both the auxiliary winding and main winding voltages. This difference will persist even as the main's voltage changes.

Figure 10:
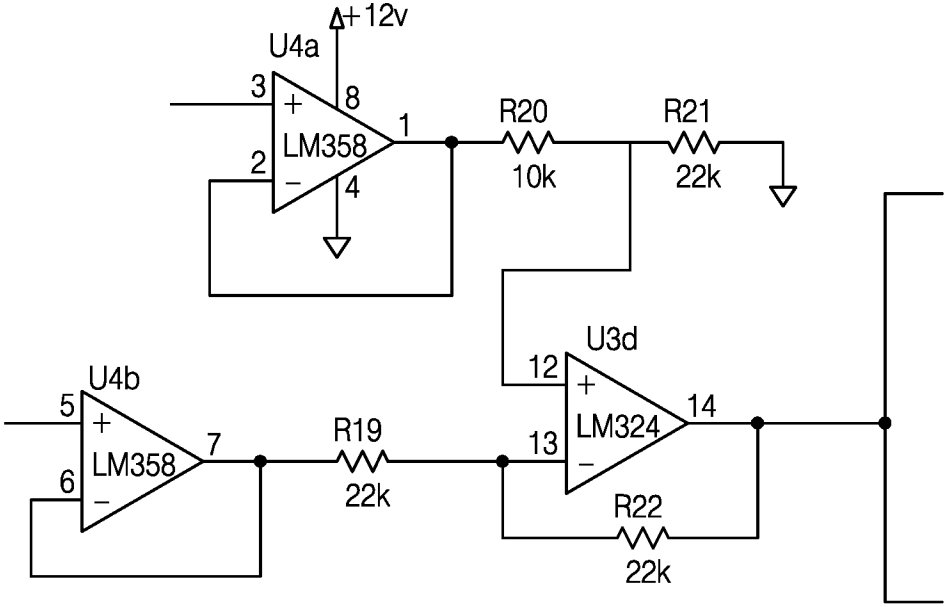
FIG. 10 is an enlarged view of a representative portion of the circuit of FIG. 17.

FIG. 10 shows the subtraction of fan auxiliary winding to main winding voltage is outputted by the difference amplifier U3*d*. U3*d* is the first stage of the second LM324 operational amplifier employed by the TFM100 circuit. In the traditional differential amplifier configuration, the output will be the voltage at the non-inverting (+) input minus the voltage at the inverting (−) input. Gain can be introduced on either side of the inputs depending on the selection of resistor values. In this configuration, the fan motor-main winding detection voltage is fed to the non-inverting input and will typically be close to 6.0 volts DC.

Since the fan motor auxiliary winding detection voltage is fed to the inverting input, it will be subtracted from the 6 VDC. But with typical auxiliary winding voltages ranging from 0 to 250V P-P, as much as 9 volts DC will be present at the output of the U4*b* buffer if both inputs are handled equally. Since the circuit operates from a single-supply (+12V VCC/0V grnd), the differential amplifier will not output the negative voltage resulting from this subtraction. To compensate for this condition, both inputs do not pass through equal voltage dividers (see FIG. 9). The result is that the output on buffer U4*a* (main winding voltage) will typically be ×3 times higher than the output on U4*b* (auxiliary winding voltage). Gain is also introduced on the non-inverting section of the differential amplifier to multiply the mains detection voltage. R20 is 10kO. R19, R21, and R22 are 22kO. The calculations for the output are as follows:

$$Vout=(VFM*((R22+R19)*R21)/((R21+R20)*R19))-(VFA*(R22/R19))Vout=(VFM*(44000*22000)/(32000*22000))-(VFA*(22000/22000))$$
$$Vout=VFM*1.375-VFA$$

So the motor main winding detection voltage will be multiplied by 1.375 before the auxiliary winding detection voltage is subtracted from it. The differential amplifier will output between 4.0V and 7.5V depending on the operating conditions of the fan.

Figure 11:
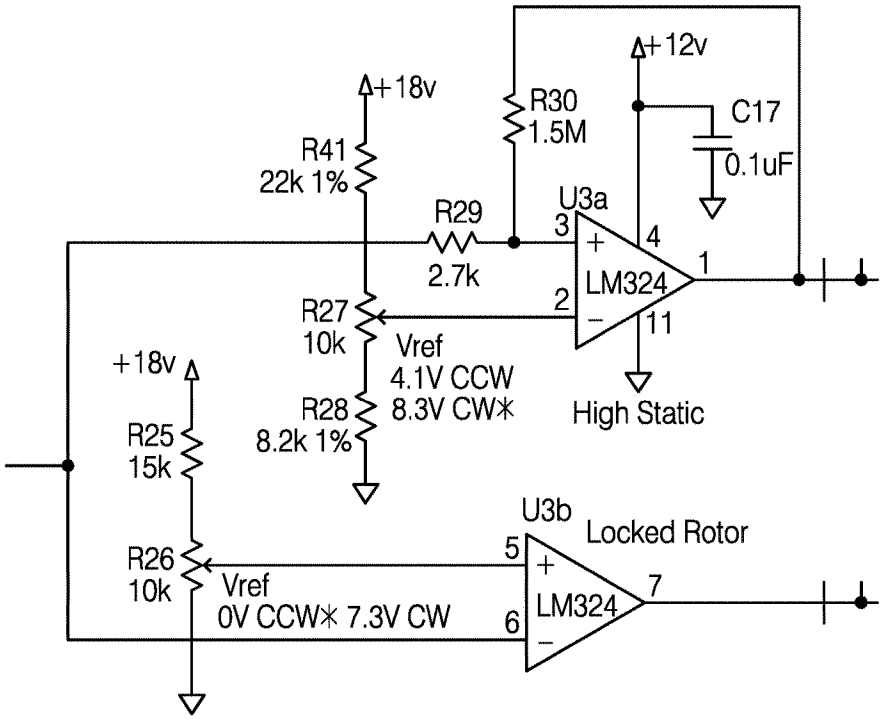
FIG. 11 is an enlarged view of a representative portion of the circuit of FIG. 17.

FIG. 11 shows the output of the U3*d* difference amplifier is fed to U3*a* and U3*b*, which is configured as an "outside" window comparator. The window comparator will separately output a high signal (12V) when the input goes above the upper setpoint, or below the lower setpoint. When the input is in between both upper and lower setpoints (fan operating at design RPM), both U3*a* and U3*b* comparators will output low (0V).

U3*a* monitors the high static pressure condition. The non-inverting input (+) receives the voltage output of U3*d*. The inverting input (−) is fed by the voltage divider formed by R41, R27, and R28 which determines the high static pressure setpoint. This voltage divider is fed by the 18V unregulated supply. R41 is a 22kO resistor, R27 is a 10kO single turn trimmer potentiometer and R28 is an 8.2kO resistor. The wiper pin of R27 is fed to the non-inverting input of U3*a*. This would give a 0-8.3V setpoint range, but the lower end of the setpoint range is limited to 4.1V by R28. When the input signal on the non-inverting input exceeds the setpoint on the inverting input, U3*a* will output high (12V).

U3*b* monitors the locked rotor condition. The inverting input (−) receives the voltage output of U3*d*. The non-inverting input (+) is fed by the voltage divider formed by R25 and R26, which determines the low RPM setpoint. This voltage divider is also fed by the 18V unregulated supply. R26 is a 10kO single turn trimmer potentiometer and R25 is a 15kO resistor. The wiper pin of R26 is fed to the inverting input of U3*b*. This would give a 0-12V setpoint range, but the upper end of the setpoint range is limited to 8V by R25. When the input signal on the inverting input falls below the setpoint on the non-inverting input, U3*b* will output high (12V).

The output of U3*a* bounces when the input on the (+) pin is very close to the setpoint on pin (−), so hysteresis is added to U3*a* via resistors R29 (2.7kO) and R30 (1.5MO). The hysteresis is calculated as: VHYS=(VOH−VOL)*((R29/(R29+R30))

$$VHYS=(12.0V-0.0V)*(2700/1506700)$$
$$VHYS=12*0.0018=0.0216V$$

Figure 12:
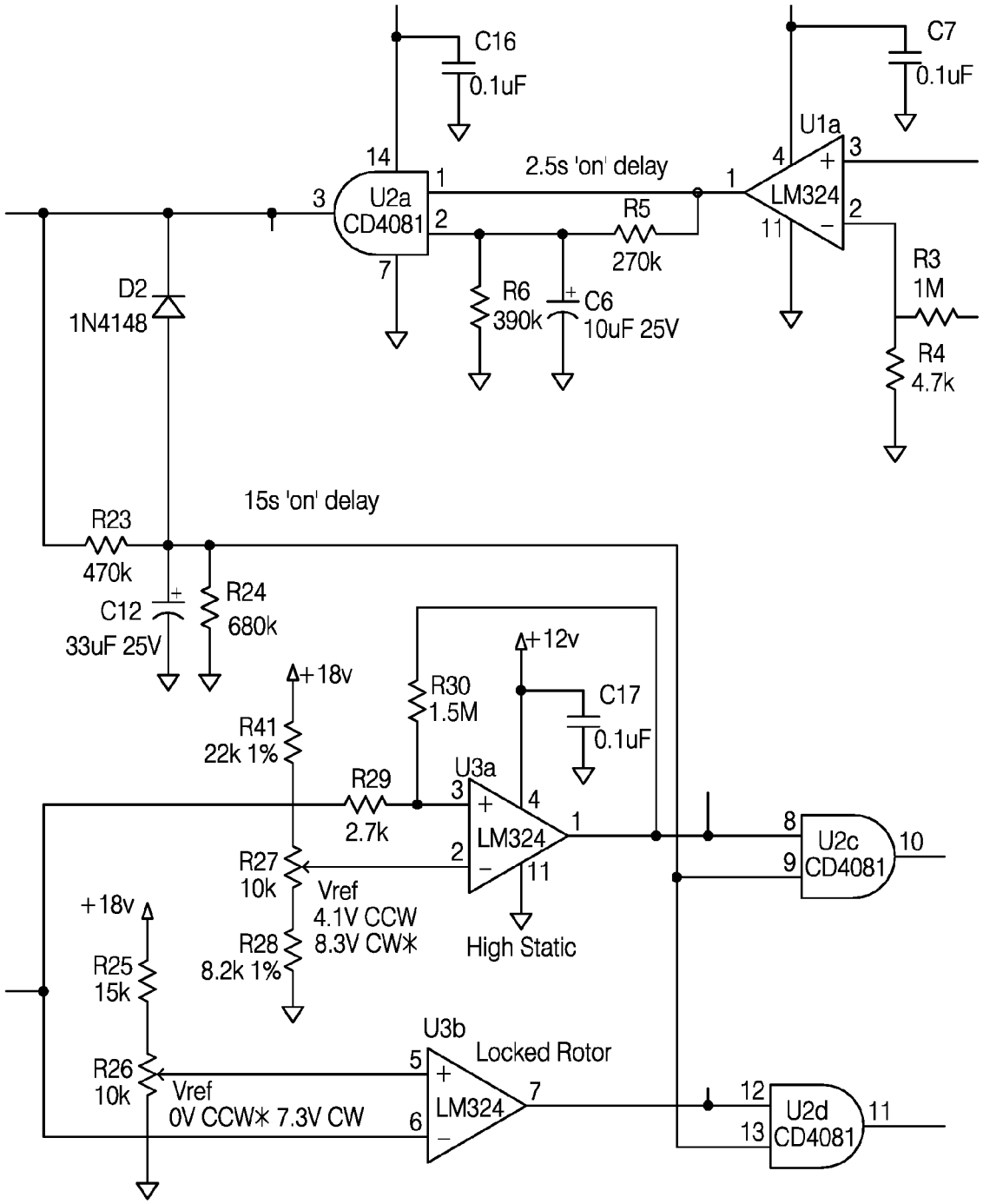
FIG. 12 is an enlarged view of a representative portion of the circuit of FIG. 17.

FIG. 12 shows when U2*a* goes high (after 2.5 seconds of continuous input from the remote sensor) and the connected fan is first started, the U3*a*/U3*b* window comparator would naturally indicate that the fan is in a low RPM condition. At startup, the voltage on the auxiliary motor winding is below the main's voltage thus the (−) input on comparator U3*b* would likely fall below the setpoint on the (+) terminal. U3*b* would immediately swing high until the fan reaches full design RPM sending 12V to the blinker circuit. The LED would blink in an error condition each time the fan first starts unless this indication can be delayed.

The delay is accomplished by two more stages of the CD4081 quad AND gate. Gate U2*c* receives one input from U3*a* and gate U2*d* receives one input from U3*b*. Each gate will only pass the U3*a*/U3*b* high (12V) condition along to the remainder of the circuit if the second input pin is also high (12V). So the second input pin of each U2*c* and U2*d* gate must be held low while the fan first starts up. It was determined that this "delayed enable" should be approximately 15 seconds.

The delayed indication enable is accomplished by R23 and C12. When U2*a* first swings high to 12V (after 2.5 seconds of continuous input from the remote sensor) the relay will close and the fan will start. The output of U2*a* will also charge a 22 μF capacitor (C12) via a 470kO resistor (R23). The output of this RC network is connected to the second input of both U2*c*/U2*d* comparators. A 680kO resistor (R24) is connected across C12 to aid in charge timing and to help keep the inputs at U2*c*/d low during off cycles. R23 and R24 form a voltage divider, the maximum voltage on C12 will only ever reach 60% of the supply voltage, or 7.1V. But this 7.1V is still enough to place the input of U2*c* and U2*d* at a "high" logic state. It takes the R23/C12 network approximately 15 seconds to reach the high logic state for the AND gate inputs. So effectively, the outputs of the window comparator U3*a* and U3*b* are prevented from passing their logic output to subsequent components for the first 15 seconds of fan operation. Once the cycle ends, the C12 capacitor is immediately discharged (pulled to ground) by the U2*a* output via 1N4148 diode D2. With C12 at a logic "low", the voltage at the second inputs of AND gates U2*c* and U2*d* are also low, once again cutting off the outputs of U3*a*/U3*b* from the rest of the circuit. It is important that C12 and thus the enable gates U2*c* and U2*d* drop to a logic low quickly once the cycle ends. When the static pressure is near the design maximum, a quick spike in winding voltage appears in the first few seconds after the dryer fan turns off. If the enable gates stay on too long after the cycle, they would allow this quick transient in winding voltage to indicate a failure.

Figure 13:
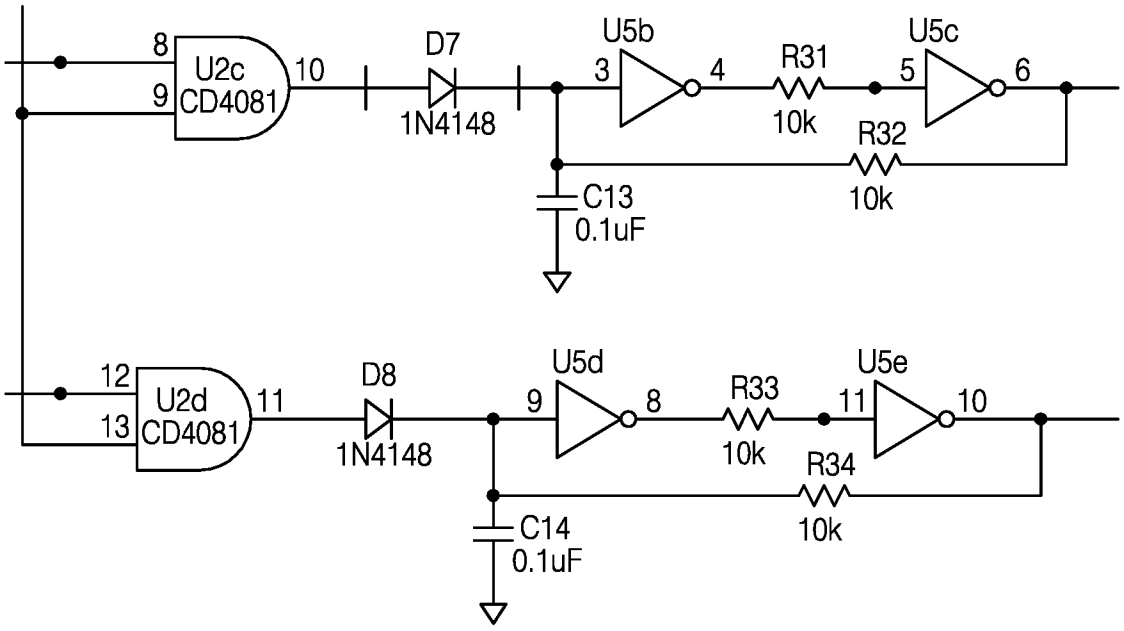
FIG. 13 is an enlarged view of a representative portion of the circuit of FIG. 17.

FIG. 13 shows when two hex inverters are connected in series with a feedback loop from the second output to the first input, a latch is formed. A momentary logic "high" (12V) placed on the input of the first inverter will result in a logic "low" output (0V) on the output. If this "low" output is then fed into the input of a second inverter, the second inverter will output a logic "high". When this logic high (12V) is fed to the input of the first inverter via a feedback loop, the cycle will continue and the output of the second inverter will remain high (or output 12V) indefinitely provided that the first input is isolated from an external low signal via a diode. The latch is in an unstable state during power-up unless additional components are added.

In this circuit, four stages of U5 (CD4069 hex inverter) are used to build two latches. Whenever either "enable" gates U2*c* or U2*d* go high (following a high signal from the window comparator U3*a*, U3*b*), these two independent latches will output a high (12V) signal to the blinker circuit. The output of each latch will continue indefinitely. This will ensure that the blinking LED indicator on the remote TFR100 board will continue to blink after the dryer cycle has ended to indicate a fault condition to the end-user.

The output of U2*c* is connected to the input of inverter U5*b* through forward-biased 1N4148 diode D7. The output of U5*b* is connected to the input of U5*c* through the 10kO resistor R31. The output of U5*c* is connected in a feedback loop back to the input of U5*b* through the 10kO resistor R32. This creates the U5*b*/U5*c* latch for the high static pressure indication triggered by U3*a*/U2*c*. R31 and R32 help keep the latched loop current low so that additional interrupt (or reset) logic components can easily break the loop. These additional components are described in a later section. C13 gives AC noise a path to ground to prevent noise from interrupting the loop logic cycle. Once the fan "on" cycle ends and the U2*c* "enable" gate goes low (0V), diode D7 will prevent the U2*c* low output from breaking the loop once the latch logic cycle has been initiated (if an error was detected while the fan was running).

The U5*d*/U5*e* latch for the low RPM indication triggered by U3*b*/U2*d* is constructed in the same fashion with components U5*d*, U5*e*, D8, R33, R34, and C14.

Figure 14:
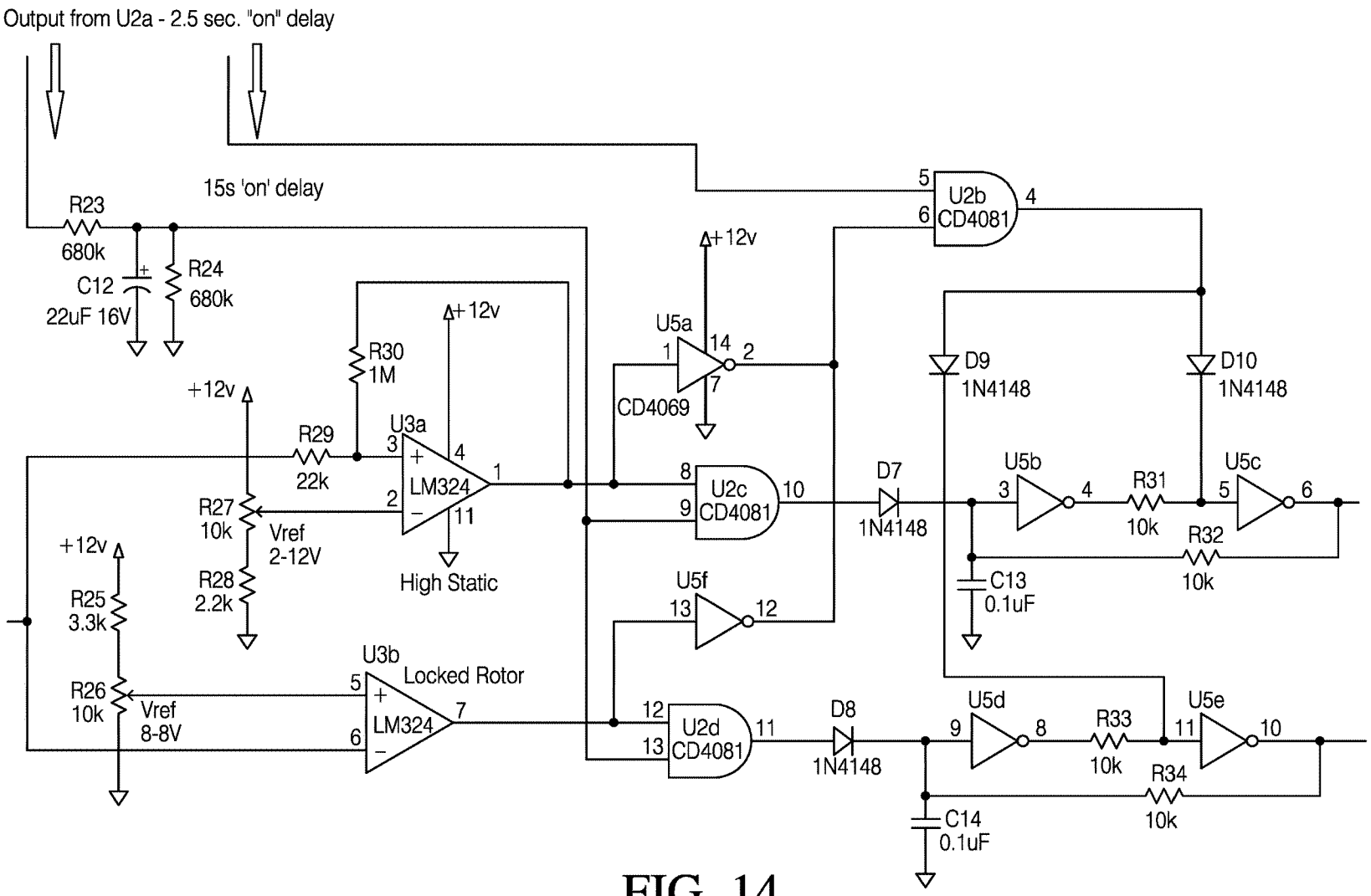
FIG. 14 is an enlarged view of a representative portion of the circuit of FIG. 17.

FIG. 14 shows the circuit needs to continue indicating a failure condition (detected by window comparator U3*a*/U3*b* while U2*c*/U2*d* gates "enabled") after the fan cycle has ended (after the output of U2*a* goes low). But the circuit should "reset" (break the loop inside the latch) each time a new cycle starts (U2*a* goes high again). The circuit should also reset the latch if the failure condition ceases while the fan is still running. Placing a logic "high" or 12V inside of a hex inverter loop will keep the loop output in a permanent low state. This is the method for activating a "reset" for each latch.

When the output of U2*a* goes high (2.5 seconds after continuous input from remote sensor), a high (+12V) signal is placed on one input of the U2*b* AND gate. This high signal will persist throughout the rest of the fan cycle. The inputs of the two remaining inverters (U5*a*, U5*f*) from the CD4069 chip are each connected to the high and low outputs (U3*a*, U3*b*) of the window comparator. The outputs of these two inverters are connected to the second input of the U2*b* AND gate. At the same instant that U2*a* first goes high, both outputs of U3*a* and U3*b* are low (0V). So high signals are outputted by both U5*a* and U5*f* to the second input of the U2*b* AND gate. When the U2*b* output is high, this is the reset condition for both latch loops. This will ensure that both latch loops will not begin the cycle in an unstable state. When either window comparator output U3*a* or U3*b* goes high to indicate a failure, either inverter U5*a* or U5*f* will now output low which brings one input of the U2*b* AND gate low. With the output of U2*b* now low, this ends the "reset" condition and the inverter loops are free to latch. If, however, this same failure condition ceases while the fan is still running (U2*a* output still high), the inverter connected to the window comparator output (either U5*a* or U5*f*) will now output high.

Regardless of the condition of the other inverter, a high signal will now be present on the second input of U2*b*. With U2*b* once again outputting a high signal, both inverter loops are once again placed into a "reset" condition. The output of U2*b* is connected to the U5*b*/U5*c* loop via 1N4148 diode D10. The output of U2*b* is connected to the U5*d*/U5*e* loop via 1N4148 diode D9. Without these diodes, a low output of U2*b* would always pull the inputs of U5*c* and U5*e* low, which will start both hex inverter loops in their "high"

(latched) output state. As soon as the fan cycle ends (U2*a* output goes low), the first of the two inputs of the U2*b* gate goes low, so U2*b* is prevented from outputting the "reset" condition to the inverter loops. If either inverter loop is in a high output state at this time (failure indication), it will hold this state until the next time the cycle begins (U2*a* goes high again).

Figure 15:
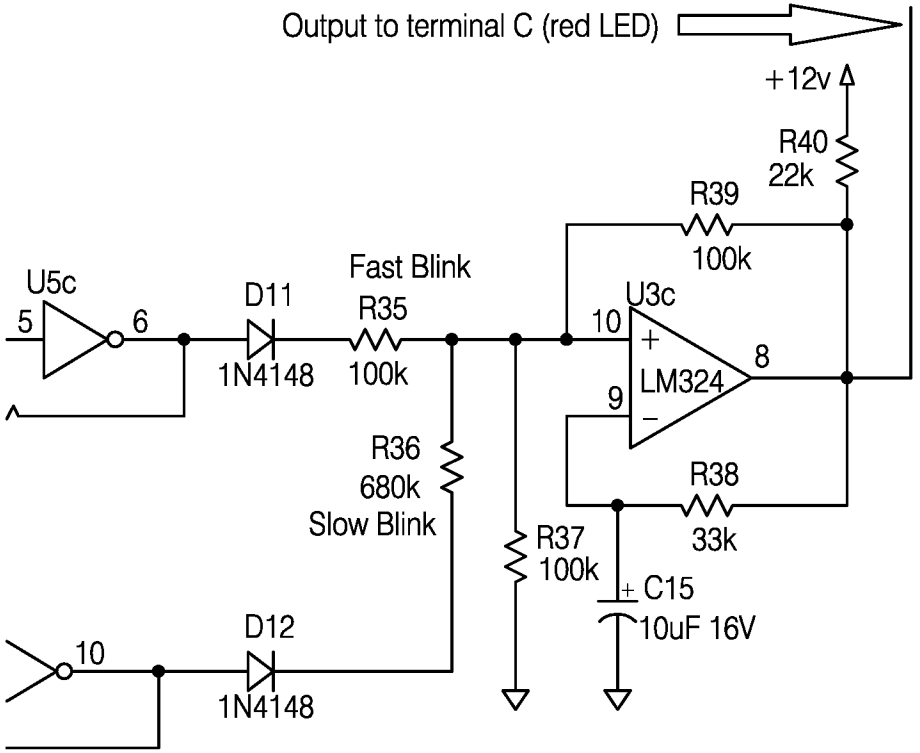
FIG. 15 is an enlarged view of a representative portion of the circuit of FIG. 17.

FIG. 15 shows the final stage of the LM324 operational amplifier, U3*c* is configured as an astable multivibrator or oscillator.

Compared to an NE555 or a dedicated comparator, LM324 op amp is not an ideal square wave oscillator due to its high slew rate. But at lower frequencies, this effect is negligible. The design frequency of this U3*c* oscillator is 2 Hz.

The rate of oscillation is determined by negative feedback resistor R38 (33kO) and the electrolytic capacitor C15 (10 μF) that ties the inverting input to ground.

It is important to keep the output of this oscillator a true square wave. If slew or crossover distortion adds slope to the trailing or leading edges of the wave, this slower rate of change may present an AC component into the output. The output (via terminal C) will be transmitted in a single wire to the remote indicator board serving the red LED. This wire is in close proximity to the other four wires inside the 5-conductor cable between the TFM100 circuit board and the TFR100 remote indicator board. Standard 5-conductor cabling has no twisted pairs or grounded shield and thus offers little to mitigate the effects of induced current between adjacent wires. This is of no concern as most of the wires carry DC currents. However, the wire connected to terminal E carries the signal from the sensor on the remote board.

When the sensor used is a current sensor, the TFR100 board will output an AC signal of low amplitude. If the U3*c* output carries any AC components, there is concern that it may induce a signal on the wire connected to terminal E, thus falsely activating the relay stages of the circuit. Since the slew rate of the U3*c* output is negligible due to the low frequency design of the oscillator, only the crossover distortion can impart this AC component (even if a very low magnitude). To ensure the oscillator has little crossover distortion, R40 is added to the circuit. This 22kO resistor connects the op amp's output to the positive rail, thus forcing class A operation of the internal transistors (the LM324 has a class B output by default).

The typical method for achieving varying frequencies with a circuit of this type is to vary the value of the feedback resistor R38. But this circuit needs to vary the output frequency depending on two different signals (from the setpoint window comparators/ sample-and-hold sections). The only place for these signals to be imparted to the oscillator is at the non-inverting input.

Figure 16:
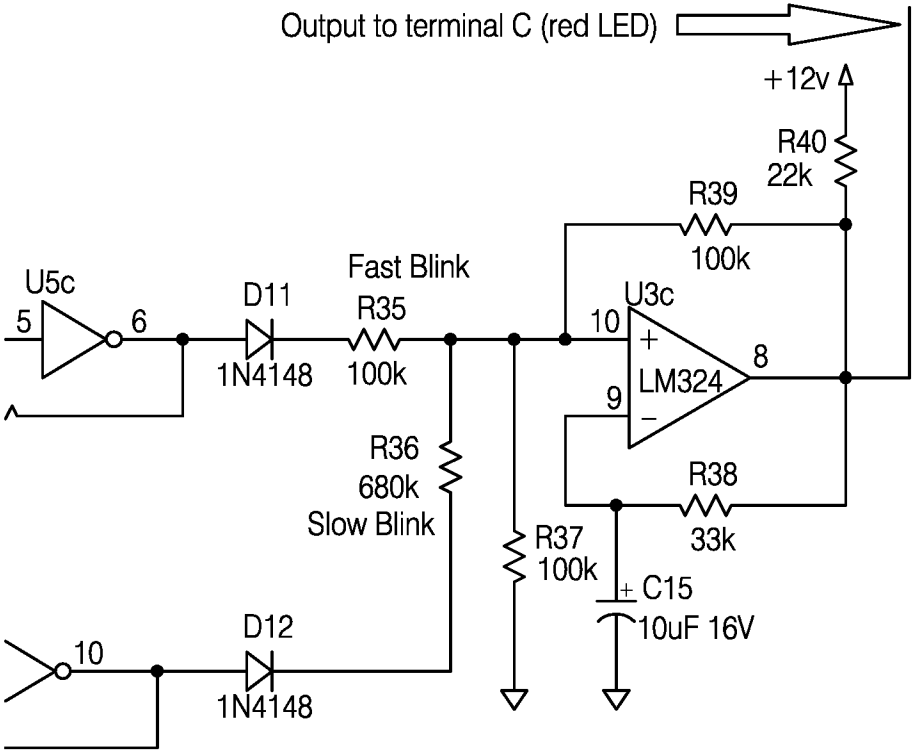
FIG. 16 is an enlarged view of a representative portion of the circuit of FIG. 17.

FIG. 16 shows the output of the high static sample and hold loop U5*b*/U5*c* is fed to a 100kO resistor R35. The output of the locked rotor sample and hold loop U5*d*/U5*e* is fed to a 680kO resistor R36. R35 and R36 are tied together to feed the non-inverting input of U3*c*. 1N4148 diodes D11 and D12 prevent either output of the sample and hold loops from triggering the other loop via its feedback loop.

R39 is a 100kO resistor that is connected between the output and non-inverting input of U3*c* to provide positive feedback. The R37 (100kO) resistor connects the non-inverting input to ground.

When the output of U3*c* is high, R35 (or R36)||R39 forms a voltage divider with R37 that supplies the reference voltage to the non-inverting input. The capacitor C15 will charge via R38. Once the voltage on the capacitor exceeds the reference voltage on the non-inverting input, the U3*c* output will swing low. Now C15 is discharging via R38 and the non-inverting input sees output from the voltage divider now formed by R35 (or R36) with R37||R39. Once C15 has discharged below this now lower threshold on the non-inverting input, the output will once again swing high and the cycle starts again. The values of R35 and R36 are used to determine the differential in C15 voltage, thus the rate of oscillation.

When the "high static" output via R35 is active, the capacitor's upper and lower charging voltages are equal to Vupper=12V*100kO/(100kO||100kO+100kO), Vlower=12V*100 k||100 k/(100 k+100 k||100 k), or Vupper=8V, Vlower=4V. The C15 voltage will charge from 4V to 8V in 0.23 seconds and also discharge from 8V to 4V in 0.23 seconds. With a time period of 0.46 seconds, the frequency at the output of the op amp should be 2.17 Hz.

When the "low RPM" output via R36 is active, the capacitor's upper and lower charging voltages are equal to Vupper=12V*100kO/(680kO||100kO+100kO), Vlower=12V*680 k||100 k/(100 k+680 k||100 k), or Vupper=6.4V, Vlower=1.4V. The C15 voltage will charge from 1.4V to 6.4V in 0.50 seconds and also discharge from 6.4V to 1.4V in 0.50 seconds. With a time period of 1 second, the frequency at the output of the op amp should be 1 Hz.

It is important to limit the current to the LED on the remote TFR100 board. With a 1kO resistor, the LED current is 10 mA. The current sourced by the output of U3*c* is well below the 20 mA maximum for this LM324 IC. The maximum safe current through the LED using standard resistor values could be 17.9 mA. If the LED intensity needs to be increased, the current limiting resistor on the LED could be as low as 560O.

FIG. 17 shows the relationships between the information shown in FIGS. 1-16 and the associated text.

Although the invention has been described in detail in the foregoing only for the purpose of illustration, it is to be understood that such detail is solely for that purpose and that variations can be made therein by those of ordinary skill in the art without departing from the spirit and scope of the invention as defined by the following claims, including all equivalents thereof. For present invention could be utilized in a radon mitigation system instead of a DEDPV. In a radon mitigation system there would be no need for the remote sensor to determine if a dryer is running.

It is thought that the method and apparatus of the present invention will be understood from the foregoing description, and that it will be apparent that various changes may be made in the form, construct steps, and arrangement of the parts and steps thereof, without departing from the spirit and scope of the invention, or sacrificing all of their material advantages. The form herein described is merely a preferred exemplary embodiment thereof.

What is claimed is:

1. A system for controlling air flow in an air flow passage comprising:

a motor;

a fluid movement inducing element coupled to and being powered for operation by said motor;

said motor having a first winding and a second winding; and a fan control circuit comprising:

a second winding voltage detector;

a first winding voltage detector; and said fan control circuit configured to do one of:

compare a voltage difference between a measured voltage on said first winding and a measured voltage on said second winding, to a first predetermined set point;

compare said voltage difference to a second predetermined set point; and said fan control circuit further configured for providing one of:

enabling an indication when said voltage difference is not between said first predetermined set point and said second predetermined set point; and providing a control signal for controlling power provisioning to said motor.

2. The system of claim 1 wherein said fluid movement inducing element induces air movement in a dryer exhaust duct.

3. The system of claim 2 further comprising a remote sensor for detecting an operation of a clothes dryer.

4. The system of claim 3 wherein said remote sensor is coupled to said fan control circuit via an electric conductor.

5. The system of claim 4 wherein said fan control circuit is free of any input from a hall effect sensor and free of input from any structure which contacts air flowing through the dryer exhaust duct for the sole purpose of determining pressure in said dryer exhaust duct.

6. The system of claim 5 wherein said remote sensor is clip-on current sensor in a dryer power connection compartment of a clothes dryer.

7. The system of claim 6 where said remote sensor is plugged into a power receptacle and said clothes dryer is plugged into said remote sensor.

8. The system of claim 7 wherein said motor receives power through said remote sensor.

9. The system of claim 8 wherein said remote sensor is plugged into a visible receptacle and further comprise a visual indicator representative of an operational state of said motor.

10. The system of claim 9 wherein said motor is an electric motor.

11. A system for controlling air flow in an air flow passage comprising:

an electric motor;

an air movement inducing element coupled to and being powered for operation by said electric motor;

said electric motor having a main winding and an auxiliary winding; and a fan control circuit comprising:

an auxiliary winding voltage detector;

a main winding voltage detector; and said fan control circuit configured to do one of:

compare a voltage difference between a measured voltage on said main winding and a measured voltage on said auxiliary winding, to a first predetermined set point;

compare said voltage difference to a second predetermined set point; and said fan control circuit further configured for providing one of:

enabling an indication when said voltage difference is not between said first predetermined set point and said second predetermined set point;

providing a control signal for controlling power provisioning to said motor, wherein said air movement inducing element induces air movement in a dryer exhaust duct; further comprising a remote sensor for detecting an operation of a clothes dryer; wherein said remote sensor is coupled to said fan control circuit via an electric conductor;

wherein said fan control circuit is free of any input from a hall effect sensor and free of input from any structure which contacts air flowing through the dryer exhaust duct for the sole purpose of determining pressure in said dryer exhaust duct;

wherein said remote sensor is clip-on current sensor in a dryer power connection compartment of a clothes dryer;

wherein said remote sensor is plugged into a power receptacle and said clothes dryer is plugged into said remote sensor; and wherein said electric motor receives power through said remote sensor; wherein said remote sensor is plugged into a visible receptacle and further comprise a visual indicator representative of an operational state of said electric motor.

12. A system for controlling air flow in an air flow passage comprising:

an electric motor;

an air movement inducing element coupled to and being powered for operation by said electric motor;

said electric motor having a main winding and an auxiliary winding; and a fan control circuit comprising:

an auxiliary winding voltage detector;

a main winding voltage detector; and said fan control circuit configured to do one of:

compare a voltage difference between a measured voltage on said main winding and a measured voltage on said auxiliary winding, to a first predetermined set point;

compare said voltage difference to a second predetermined set point; and said fan control circuit further configured for providing one of:

enabling an indication when said voltage difference is not between said first predetermined set point and said second predetermined set point; and providing a control signal for controlling power provisioning to said electric motor.

13. The system of claim 12 wherein said air movement inducing element induces air movement in a dryer exhaust duct.

14. The system of claim 13 further comprising a remote sensor for detecting an operation of a clothes dryer.

15. The system of claim 14 wherein said remote sensor is coupled to said fan control circuit via an electric conductor.

16. The system of claim 15 wherein said fan control circuit is free of any input from a hall effect sensor and free of input from any structure which contacts air flowing through the dryer exhaust duct for the sole purpose of determining pressure in said dryer exhaust duct.

17. The system of claim 16 wherein said remote sensor is clip-on current sensor in a dryer power connection compartment of a clothes dryer.

18. The system of claim 16 wherein said remote sensor is plugged into a power receptacle and said clothes dryer is plugged into said remote sensor.

19. The system of claim 18 wherein said electric motor receives power through said remote sensor.

20. The system of claim 19 wherein in said remote sensor is plugged into a visible receptacle and further comprise a visual indicator representative of an operational state of said electric motor.

* * * * *